US009718523B2

(12) United States Patent
Tan et al.

(10) Patent No.: US 9,718,523 B2
(45) Date of Patent: Aug. 1, 2017

(54) GLIDING ROBOTIC FISH NAVIGATION AND PROPULSION

(71) Applicant: Board of Trustees of Michigan State University, East Lansing, MI (US)

(72) Inventors: Xiaobo Tan, East Lansing, MI (US); Feitian Zhang, Greenbelt, MD (US); Jianxun Wang, Plainsboro, NJ (US); John Thon, Mason, MI (US)

(73) Assignee: Board of Trustees of Michigan State University, East Lansing, MI (US)

( * ) Notice: Subject to any disclaimer, the term of this patent is extended or adjusted under 35 U.S.C. 154(b) by 149 days.

(21) Appl. No.: 14/522,072

(22) Filed: Oct. 23, 2014

(65) Prior Publication Data

US 2015/0120045 A1 Apr. 30, 2015

Related U.S. Application Data

(60) Provisional application No. 61/895,116, filed on Oct. 24, 2013.

(51) Int. Cl.
*B63G 8/00* (2006.01)

(52) U.S. Cl.
CPC ..... *B63G 8/001* (2013.01); *B63G 2008/005* (2013.01)

(58) Field of Classification Search
CPC ..... B63G 8/001; B63G 8/04–8/08; B63G 8/14–8/26; B63G 2008/14–2008/26; B63G 2008/002–2008/008
See application file for complete search history.

(56) References Cited

U.S. PATENT DOCUMENTS 5,291,847 A 3/1994 Webb
8,132,525 B2 * 3/2012 Herbek ..... B63G 8/08 114/312
9,096,106 B2 8/2015 Hanson et al.
2005/0275372 A1 * 12/2005 Crowell ..... H02J 7/0018 320/112

(Continued)

OTHER PUBLICATIONS

Abdulsadda et al. "An Artificial Lateral Line System Using IPMC Sensor Arrays" International Journal of smart and Nano Materials, vol. 3, No. 3, pp. 226-242, 2012.

(Continued)

*Primary Examiner* — Adam Mott
(74) *Attorney, Agent, or Firm* — Harness, Dickey & Pierce, PLC

(57) ABSTRACT

A robotic submersible includes a housing having a body and a tail. In another aspect, a pump and a pump tank adjust the buoyancy of a submersible housing. In a further aspect, a first linear actuator controls the pump and/or a buoyancy, and/or a second linear actuator controls a position of a battery and/or adjusts a center of gravity. Another aspect includes a pump and at least one linear actuator that control gliding movements of the housing. In still a further aspect, a motor couples a tail with a body, such that the motor controls the movements of the tail to create a swimming movement. Moreover, an additional aspect provides a controller selectively operating the pump, first actuator, second actuator, and motor to control when swimming and gliding movements occur.

35 Claims, 8 Drawing Sheets

(56) References Cited

U.S. PATENT DOCUMENTS

2009/0245025 A1* 10/2009 Rhodes ..... H04B 13/02 367/134
2010/0268409 A1* 10/2010 Vian ..... G05D 1/104 701/24
2012/0318188 A1 12/2012 Hudson et al.

OTHER PUBLICATIONS

Abdulsadda et al. "Artificial Lateral Line-Based Localization of a Dipole Source with Unknown Vibration Amptitude and Direction" in Proceedings of the 15th International Conference on Advanced Robotics, Tallinn, Estonia, pp. 447-452, 2011.
Alag et al. "A Methodology for Intelligent Sensor Validation and Fusion used in Tracking and Avoicance of Objects for Automated Vehicles" in American Control Conference, IEEE, pp. 3647-3653, 1995.
Aureli, et al. "Free-Locomotion of Underwater Vehiclels Actuated by Ionic Polymer Metal Composites" IEEE/ASME Trans. Mechatronics, vol. 15, No. 4, pp. 603-614, Aug. 2010.
Bandyopadhyay et al. "Synchronization of Animal-Inspired Multiple High-Lift Fins in an Underwater Vehicle Using Olivo-Cerebellar Dynamics" IEEE J. Ocean. Eng . . . vol. 33, No. 4, pp. 563-578, Oct. 2008.
Bandyopadhyay, "Trends in Biorobotic Autonomous Undersea Vehicles" IEEE J. Ocean. Eng., vol. 30, No. 1, pp. 109-139, Jan. 2005.
Baras et al. "Decentralized Control of Autonomous Vehicles" in The 42nd IEEE Conference on Decision and Control (CDC). IEEE, pp. 1532-1537, 2003.
Barrett et al. "Drag Reduction in Fish-Like Locomotion" Journal of Fluid Mechanics, vol. 392, No. 1, pp. 183-212, 1999.
Chen, et al. "Modeling of Biomimetic Robotic Fish Propelled by an Ionic Polymer-Metal Composite Caudal Fin" IEEE/ASME trans. Mechatronics, vol. 15, No. 3, pp. 448-459, Jun. 2010.
Clark et al. "Tracking and following a Tagged Leopard Shark with an Autonomous Underwater Vehicle" Journal of Field Robotics, vol. 30, pp. 309-322, 2013.
Detweiler et al. "Adaptive Decentralized control of Underwater Sensor Networks for Modeling Underwater Phenomena" in the 8th ACM Conference on Embedded Networked Sensor systems (SenSys), ACM 253-266, 2010.
Dunbabin et al. "Robotics for Environmental Monitoring" IEEE Robot. Automat. Mag., vol. 19, No. 1, pp. 24-39, 2012.
Ehrenberg et al. "A Method for Estimating the "Position Accuracy" of Acoustic Fish Tags" ICES Journal of Marine Science, vol. 59, pp. 140-149, 2002.
Eiler et al. "Comparing Autonomous Underwater Vehicle (AUV) and Vessel-Based Tracking Performance for Locating Acoustically Tagged Fish" Marine Fisheries Review, vol. 75, pp. 27-42, 2013.
Eriksen et al. "Seaglider: A Long-Range Autonomous Underwater Vehicle for Oceanographic Research" IEEE Journal of Oceanic Engineering, vol. 26, No. 4, pp. 424-436, 2001.
Espinoza et al. "Testing a New Acoustic Telemetry Technique to Quantify Long-Term, Fine-Scale Movements of Aquatic Animals" Fisheries Research, vol. 108, pp. 364-371, 2011.
Graver, J.G. et al., "Underwater glider model parameter identification," 13th Int. Symp. Unmanned Untethered Submersible Technol . . . , Durham, NH, USA, 2003.
Grothues et al. "Collecting, Interpreting, and Merging Fish Telemetry Data from an AUV: Remote Sensing from an Already Remote Platform" in Autonomous Underwater Vehicles (IEEE/OES AUV 2010), Monterey, CA, pp. 1-9, 2010.
Kopman et al. "Design, Modeling, and Characterizatin of a Miniature Robotic Fish for Research and Education in Biomimetics and Bioinspiration", Mechatronics IEEE/ASME Transactions on, vol. 18, No. 2, pp. 471-483, 2013.
Leonard et al. "Coordinated Control of an Underwater Glider Fleet in an Adaptive Ocean Sampling Field Experiment in Monterey Bay", Journal of Fleld Robotics, vol. 27, No. 6, pp. 718-740, 2010.
Leonard et al. "Model-Based Feedback Control of Autonomous Underwater Gliders" IEEE Journal of Oceanic Engineering, vol. 26, No. 4, pp. 633-645, 2001.
Liu et al. "Hydrodynamics of an Undulating Fin for a Wave-Like Locomotion System Design" IEEE/ASME Trans. Mechatronics, vol. 17, No. 3, pp. 554-562, Jun. 2012.
Low et al. "Active Markov Information_Theoretic Path Planning for Robotic Environmental Sensing" in the 10th International Conference on Autonomous Agents and Multiagent Systems, pp. 753-760, 2011.
Low et al. "Adaptive Multi-Robot Wide-Area Exploration and Mapping" in the 7th International Conference on Autonomous Agents and Miltiagent Systems, pp. 23-30, 2008.
Low et al. "Decentralized Active Robotic Exploration and Mapping for Probabilistic Field Classification in Environmental Sensing" in the 11th International Conference on Autonomous Agents and Multiagent Systems, pp. 105-112, 2012.
Low et al. "Information-Theoretic Approach in Efficient Adaptive Path Planning for Mobile Robotic Enfironmental Sensing" in the 19th International Conference on Automated Planning and Scheduling, pp. 233-240, 2009.
Mahmoudian et al. "Approximate Analytical Turning Conditions for Underwater Gliders: Implications for Motion Control and Path Planning" IEEE Journal of Oceanic Engineering, vol. 35, No. 1, pp. 131-143, 2010.
Morgansen et al. "Geometric Methods for Modeling and Control of Free-Swimming Fin-Actuated Underwater Vehicles" IEEE Transactions on Robotics, vol. 23, No. 6, pp. 1184-1199, 2007.
NBC News "Robo Fish can Glide (almost) Forever" [Online] Available: http://www.nbcnews.com/technology/futureoftech/rogo-fish-can-glide-almost-forever-187987620.
Nielsen et al. "Mobile Positioning of Tagged Aquatic Animals Using Acoustic Telemetry with a Synthetic Hydrophone Array (SYNAPS: Synthetic Aperture Positioning System)." in Proceedings of the 2nd International Symposium on Advances in Fish Tagging and Marking Technology, J. McKenzie, B. Parsons, A. Seitz, M. Mesa, R.K. Kopf, Q. Phelps, and K. West, Eds. Bethesda, Maryland: american Fisheries Society, pp. 233-250, 2011.
NSF (2013) Air Option 1: Technology Translation: Gliding Robotic Fish for Long-Duration Sensing in Aquatic Environments. [Online]. Available: http://www.nsf.gov/awardsearch/showAward?AWD_ID=1343413.
Rudnick et al. "Underwater Gliders for Ocean Research" Marine Technol. Soc. J., vol. 38, No. 2, pp. 73-84, 2004.
S. Lin et al. "ATPC: Adaptive Transmission Power Control for Wireless Sensor Networks." in the 4th International Conference on Embedded Networked Sensor Systems (SenSys), ACM, pp. 223-236, 2006.
Sherman et al. "The Autonomous Underwater Glider Spray" IEEE J. Ocean Eng., vol. 26, No. 4, pp. 437-446, 2001.
Singh et al. "Underwatr Acoustic Navigation with the WHOI Micro-Modem" in Proceedings of the IEEE/MTS Oceans Conference, Boston, MA pp. 1-4, 2006.
Tokekar et al. "A Robotic System for Monitoring carp in Minnesota Lakes" Journal of Field Robotics, vol. 27, pp. 779-789, 2010.
Wang et al"Spatiotemporal Aquatic Field Reconstruction Using Robotic Sensor Swarm" in Proceedings of the 33rd IEEE Real-Time Systems Symposium (RTSS). IEEE, pp. 205-214, 2012.
Wang et al. "A Dynamic Model for Tail-Actuated Robotic Fish with Drag Coefficient Adaptation" Mechatronics, vol. 23, pp. 659-668, 2013.
Wang et al. "Accuracy-Aware Aquatic Diffusion Process Profiling Using Robotic Sensor Networks" in Proceedings of the 11th International Conference on Information Processing in Sensor Networks (IPSN) ACM/IEEE, pp. 281-292, 2012.
Wang et al. "Aquatic Debris Monitoring Using Smartphone-Based Robotiic Sensors" in Proceedings of the 13th ACM/IEEE International Conference on Information Processing in Sensor Networks (IPSN), Berlin, Germany, pp. 13-24, 2014.

(56) References Cited

OTHER PUBLICATIONS

Wang et al. "Dynamic Modeling of Robotic Fish and its Experimental Validation" in Proceedings of the 2011 IEEE/RSJ International Conference on Intelligent Robots and Systems, San Francisco, CA, pp. 588-594, 2011.
Wang et al. "Profiling Aquatic Diffusion Process Using Robotic Sensor Networks" IEEE Transactions on Mobile Computing, vol. 13, No. 4, pp. 880-893, Feb. 1, 2013.
Webb et al. "SLOCUM: An Underwater glider Propelled by Environmental Energy" IEEE J. Ocean. Eng . . . vol. 26, No. 4, pp. 447-452, Oct. 2001.
X. Tan, "Autonomous Robotic Fish as Mobile Sensor Platforms: Challenges and Potential Solutions" Marine Technology Society Journal, vol. 45, No. 4, pp. 31-40, 2011.
Yu et al. "On a Bio-Inspired Amphibious Robot Capable of Multimodal Motion" IEEE/ASME, Trans. Mechatronics, vol. 17, No. 5,pp. 847-856, Oct. 2012.
Zhang et al "Steady Spiraling Motion of Gliding Robotic Fish" in Proceedings of the 2012 IEEE/RSJ International Conference on Intelligent Robots and Systems, Vilamoura Algarve, Portugal, pp. 1754-1759, 2012.
Zhang et al. "Adaptive Sampling and Estimating a Scalar Field Using a Robotic Boat and a Sensor Network" in IEEE International Conference on Robotics and Automation (ICRA) IEEE, pp. 3673-3680, 2007.
Zhang et al. "Gliding Robotic Fish and its Tail-enabled Yaw Motion Stabilization using Sliding Mode Control" in 2013 ASME Dynamic Systems and Control (DSC) Conference, Palo Alto, CA 2013, paper DSCC2013-4015.
Zhang et al. "Gliding Robotic Fish for Mobile Sampling of Aquatic Environments" in Proceedings of 11th IEEE International Conference on Networking, Sensing and Control, Miami, FL 2014, pp. 167-172.
Zhang et al. "Miniature Underwater Glider: Design and Experimental Results" in Proceedings of the 2012 IEEE International conference on Robotics and Automation, St. Paul, MN 2012, pp. 4904-4910.
Zhang et al. "Nonlinear Observer Design for Stabilization of Gliding Robotic Fish" in Proceedings of the 2014 American Control Conference, Portland, OR, 2014.
Zhang et al. "Passivity-Based Controller Design for Stabilization of Underwater Gliders" in American Control Conference (ACC) 2012, IEEE, 2012, pp. 5408-5413.
Zhang et al. "Passivity-Based Stabilization of Underwater Gliders with a Control Surface" Journal of Dynamic Systems, Measurement and Control, under review.
Zhang et al. "Spiraling Motion of Underwater Gliders: Modeling, Analysis and Experimental Results" Ocean Engineering, vol. 60, pp. 1-13, 2013.
Zhang et al. "Tail-enabled Spiraling Maneuver for Gliding Robotic Fish", Journal of Dynamic Systems, Measurement, and Control, 2014, vol. 136, No. 4, 041028.
Zhang et al. "Three-Dimensional Spiral Tracking control for gliding Robotic Fish" in 53rd IEEE Conference on Decision and Control, Los Angeles, CA, 2014, accepted.
Zhou et al. "Design and Locomotion Control of a Biomimetic Underwater Vehicle with Fin Propulsion" IEEE/ASME Trans. Mechatronics, vol. 17, No. 1, pp. 25-35, Feb. 2012.

* cited by examiner

GLIDING ROBOTIC FISH NAVIGATION AND PROPULSION

CROSS-REFERENCE TO RELATED APPLICATIONS

This application claims the benefit of U.S. Provisional Application No. 61/895,116, filed on Oct. 24, 2013. The entire disclosure of the above application is incorporated herein by reference.

GOVERNMENT RIGHTS

This invention was made with Government support under ECCS1050236, 0916720, and 0547131 awarded by the National Science Foundation, and N00014-08-1-0640 awarded by the Office of Naval Research. The U.S. Government has certain rights in this invention.

BACKGROUND

The present disclosure relates generally to robotic submersibles and in particular to a robotic submersible capable of propulsion through both gliding and swimming.

In recent years there has been considerable interest in and development of submersible, underwater, exploratory craft in commercial, government, and military research. The underwater frontier remains a huge and much unexplored portion of the earth, with vast riches in minerals, petroleum, seabed, plants, and aquatic life. Further, underwater monitoring of chemicals, foundations, structures, and the like, is relevant to many commercial and government entities.

Development of underwater craft has remained centered mostly around submarines, although the development of underwater gliders has recently gained focus. Underwater gliders have begun to meet needs of researchers and scientists in exploring large, deep bodies of water, such as the oceans. An underwater glider utilizes its buoyancy and gravity to enable motion without any additional propulsion, and adjusts its center of gravity to achieve a certain attitude, which results in glide and thus horizontal travel. Since energy is needed only for buoyancy and center-of-gravity adjustment when switching the glide profile, underwater gliders are very energy-efficient. However, underwater gliders are large in size (for example, 1-2 meters in length), weight (for example, at least 50 kg), and cost. Further, they are slow to move and have low maneuverability making them inadequate for smaller bodies of water.

In exploration and utilization of shallower or smaller bodies of water, it becomes increasingly important that designs for underwater craft be associated with effective and reliable control systems to improve underwater maneuverability, including the ability to swim at a faster rate than the traditional underwater glider.

Thus, there is a need for a small underwater craft that can operate autonomously to monitor aquatic environments such as lakes, rivers, streams, and coastal waters. The underwater craft must be able to capture different types of data, it must be capable of propelling itself in a variety of speeds, it must have energy-saving capabilities, and it must be maneuverable underwater.

SUMMARY

In accordance with the present invention, a robotic submersible includes a housing having a body and a tail. In another aspect, a pump and a pump tank adjust the buoyancy of a submersible housing. In a further aspect, a first linear actuator controls the pump and/or buoyancy, and/or a second linear actuator controls a position of a battery pack and/or adjusts a center of gravity. Another aspect includes a pump and at least one linear actuator that control gliding movements of the housing. In still a further aspect, at least one motor couples a tail with a body, such that the motor controls the movements of the tail to create a swimming movement. Moreover, an additional aspect provides a controller selectively operating a pump, first actuator, second actuator, and motor to control when swimming and gliding movements occur in a robotic submersible.

A method of controlling a robotic submersible is also provided.

The present robotic submersible is advantageous over prior devices. For example, the robotic submersible is able to capture different types of data autonomously and adjust for different sensors; whereas, previous underwater craft cannot change sensors because different sensors change the center of gravity and/or buoyancy of the craft. Further, the robotic submersible is capable of propelling itself in a variety of speeds, has energy-saving capabilities, and is maneuverable underwater; whereas oceanic gliders are slow moving and not maneuverable.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

Corresponding reference numerals indicate corresponding parts throughout the several views of the drawings.

DETAILED DESCRIPTION

Figure 1:
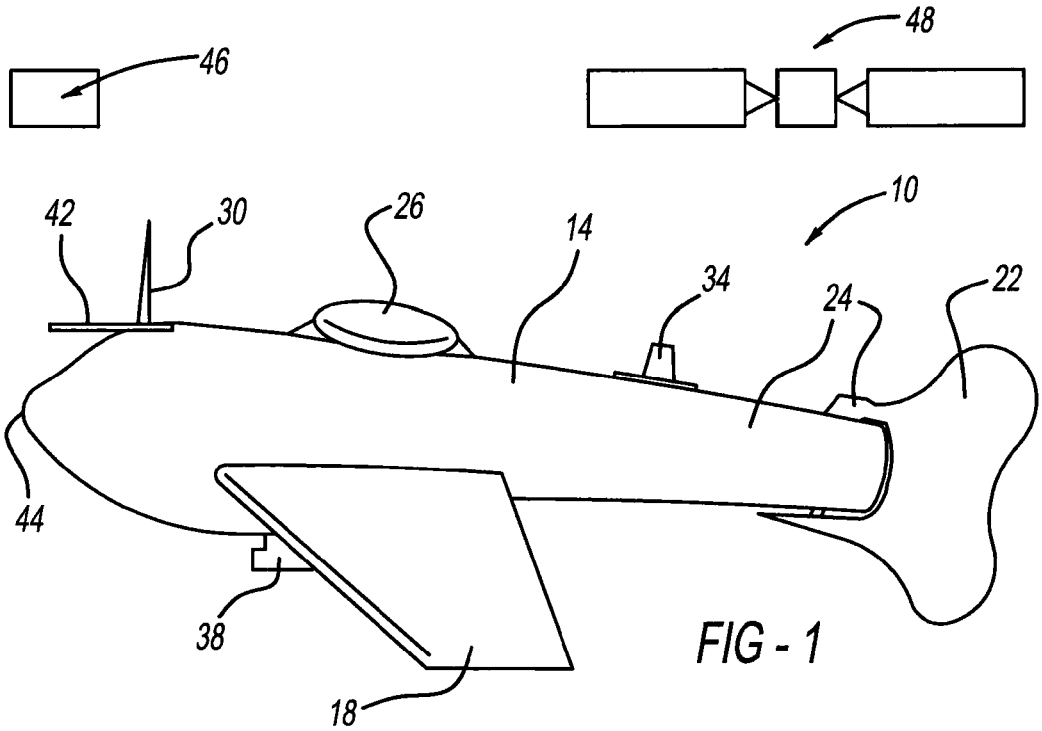
FIG. 1 is a side elevational view showing a robotic submersible according to the present disclosure.

A robotic submersible 10 is configured for deployment in a body of water (or other fluid) to collect environmental data, visual data, or sonar data about the environment in which robotic submersible 10 is located. Robotic submersible 10 is capable of autonomously operating in a plurality of travel modes, ensuring that travel is optimized in different environments and under different circumstances. Robotic submersible 10 is further capable of being reconfigured with different sensors or cameras and autonomously adapting buoyancy and center of gravity settings in response to the reconfiguration.

Generally referring to FIGS. 1-3B, robotic submersible 10 is illustrated including a body 14, a plurality of fins 18, and a tail 22. Body 14 may be a rigid body, and tail 22 may be a rigid tail. Body 14 and tail 22 form a housing 24 that encloses a plurality of internal components of the robotic submersible. For example, when neutrally buoyant, robotic submersible 10 may weigh approximately 15 kg, and body 14 may measure approximately 1 meter (m) in length.

Figure 3A:
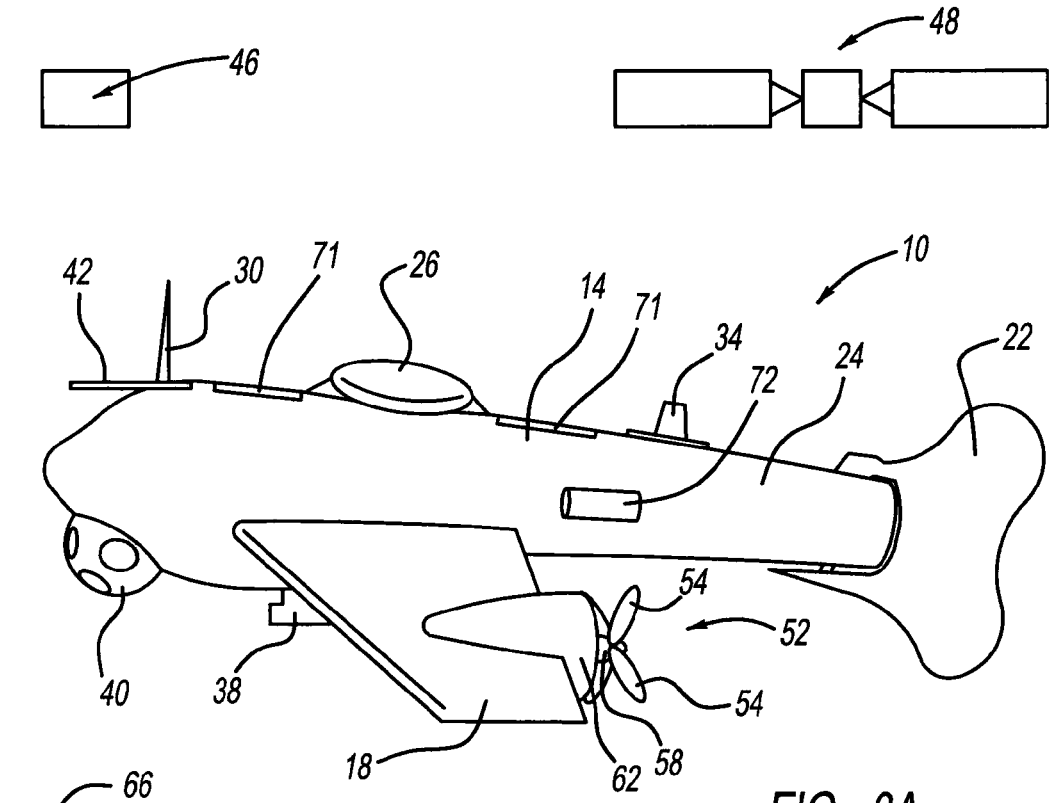
FIG. 3A is a side elevational view showing another embodiment of a robotic submersible according to the present disclosure.

Referring specifically to FIGS. 1 and 3A, the exterior of body 14 includes a global positioning system (GPS) receiver 26, a wireless communication antenna 30, and a plurality of sensors 34, 38. For example, in FIG. 1, a temperature sensor 34 and a crude oil sensor 38 (sensing the presence of oil in the monitored fluid) are illustrated. However, any number of sensors in any combination may be included on robotic submersible 10. It is noted that any sensor may be included, such as: environmental sensors, for example only the sensors could be, water quality sensors (including blue-green algae or cyanobacteria, chlorophyll, hydrocarbons from crude oil or refined fuels, dissolved oxygen, turbidity, nutrients, dissolved organic matter, conductivity or salinity, etc.), sensors for physical conditions in the water environments (such as temperature, solar irradiation, flow velocity, etc.), sensors for tracking fluorescent traces (Rhodamine, for example), depth sonar (measuring bathymetry or bridge scour, for example), cameras for optical imaging, imaging sonars (for imaging and inspection of underwater environments, structures, infrastructure, etc.), and receivers for acoustic telemetry (for tracking fish, such as invasive species, that have implanted acoustic tags). Further, body 14 may include a modular architecture to accommodate sensor payloads 40 (FIG. 3A). Sensor payloads 40 may offer surveillance benefits and assist in autonomous operation.

Sensors may be removed from or added to robotic submersible 10 depending on mission goals. Each time one or more sensors is added to, removed from, or changed locations, robotic submersible 10 must be re-ballasted before deploying on the mission. Housing 24 of robotic submersible 10 may be re-ballasted manually. A user may add or remove ballast from housing 24 to enhance the stability of robotic submersible 10. Housing 24 of robotic submersible 10 may also be re-ballasted automatically by a control system detecting the weight distribution across housing 24 of robotic submersible 10 and moving structures within housing 24 to re-ballast housing 24.

Wireless communication antenna 30 may be attached to a mount 42 on body 14 near a nose 44 on body 14 and communicates with a home base, base station, or remote control station 46. In alternative embodiments, wireless communication antenna 30 may be attached in any location on body 14, either by a mount similar to mount 42 or directly attached to body 14. Home base 46 may include a desktop computer, a laptop computer, a smart phone, a tablet, or any other home base. Wireless communication antenna 30 transmits data collected from the plurality of sensors 34, 38, receives destination information (such as coordinates), transmits location information and emergency information, and transmits any other information necessary during the deployment of robotic submersible 10 and the collection of data.

GPS receiver 26 may be mounted on the exterior of body 14 and communicates with GPS satellites 48. GPS receiver 26 may be protected from water damage by applying a clear protectant on the surface of GPS receiver 26. For example only, a clear epoxy, silicone, or other clear protectant may be applied to the surface of GPS receiver 26 to form a water-tight coating, waterproofing GPS receiver 26.

Figure 2:
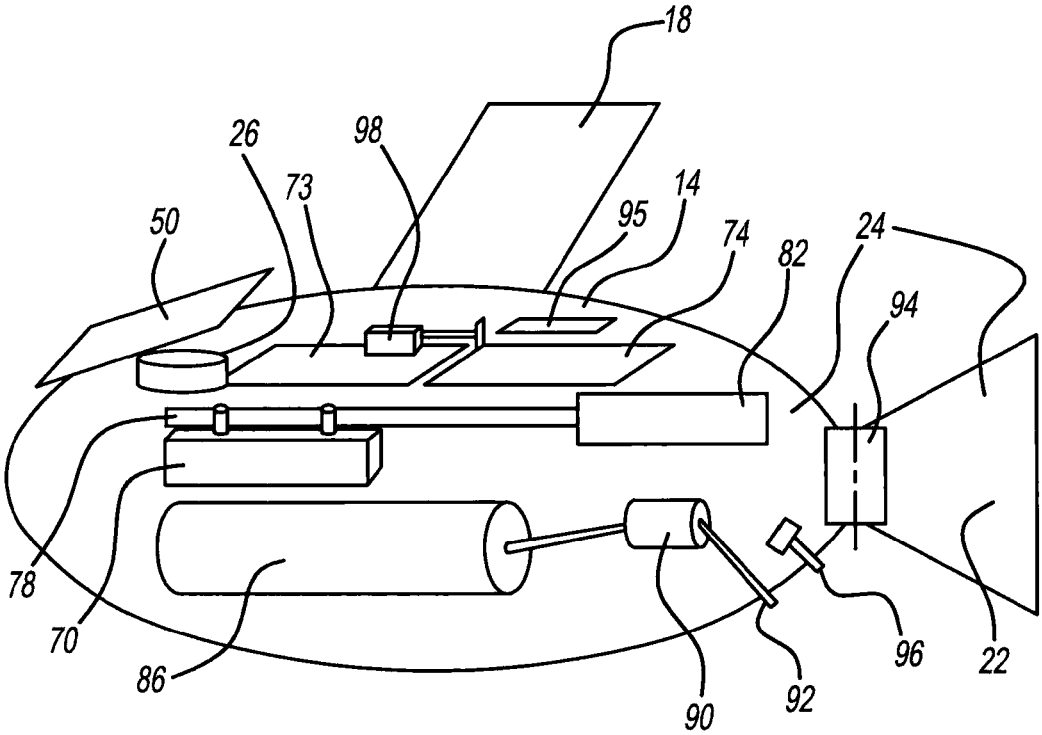
FIG. 2 is a side diagrammatic view of internal components of the robotic submersible of FIG. 1.

GPS receiver 26 may also be mounted inside housing 24 (as shown in FIG. 2). When GPS receiver 26 is mounted on the interior of housing 24, body 14 further includes a transparent window 50 allowing for communication between GPS receiver 26 and GPS satellites 48. Transparent window 50 may be glass, plexiglass, or any other transparent material.

GPS is a space-based satellite navigation system that provides location and time information in all weather conditions. Home base 46 may receive GPS location data about robotic submersible 10 through wired or wireless communication. GPS location data may include the current location of robotic submersible 10 and/or past location data (for example only, to construct a map illustrating the travel of the robotic submersible).

Now referring specifically to FIG. 3A, robotic submersible 10 may include a plurality of propellers 52 on plurality of fins 18. Propellers 52 may each include a plurality of blades 54, a shaft 58, and a motor housing 62 with a motor (not shown) for turning shaft 58 and blades 54. Propellers 52 may be activated to provide additional speed to robotic submersible 10.

Figure 3B:
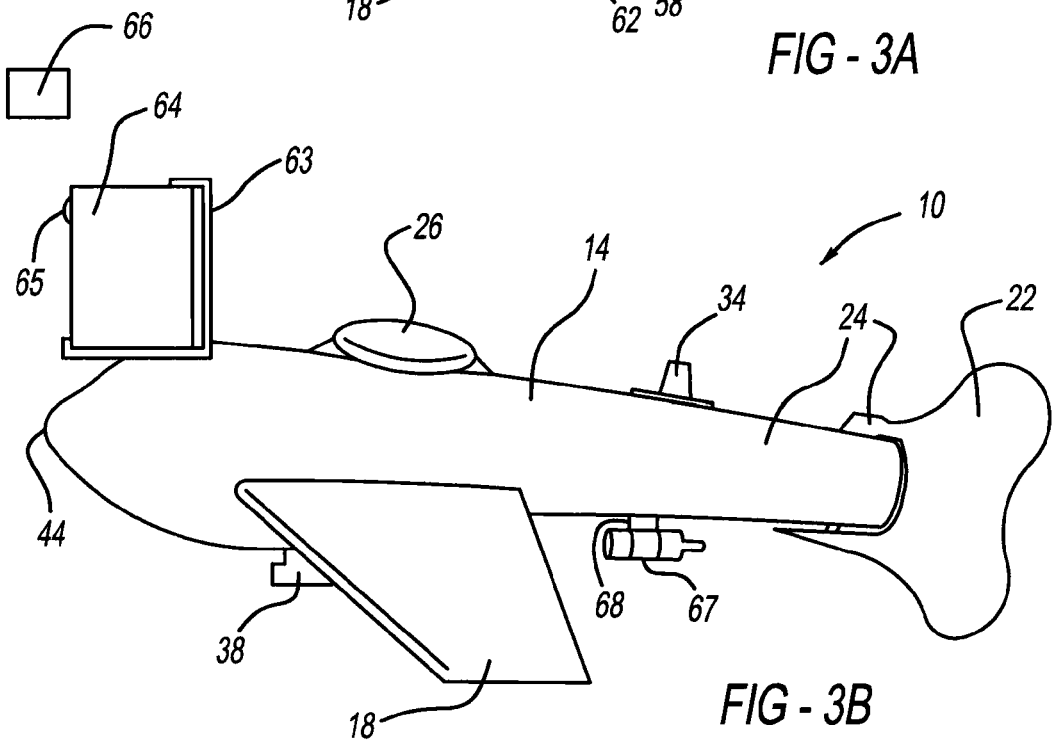
FIG. 3B is a side elevational view showing another embodiment of a robotic submersible according to the present disclosure.

Now referring specifically to FIG. 3B, body 14 may include a mount 63 for securing an external data collection and control device 64. For example only, external data collection and control device 64 may be a smartphone or other hand-held computer. External data collection and control device 64 may schedule the orientation of robotic submersible 10 and capture and process images using an onboard camera 65 in near real-time (for example only, approximately 3.7 seconds/frame). In addition, external data collection and control device 64 may adaptively offload computation to a remote storage 66, for example, cloud storage, to minimize energy consumption.

An acoustic telemetry receiver 67 may be mounted to body 14 for detecting and tracking tagged fish underwater. For example only, acoustic telemetry receiver 67 may be an adapted version of the VR2C Cabled Receiver produced by VEMCO. Acoustic telemetry receiver 67 may be secured to body 14 by a mount 68. Acoustic telemetry receiver 67 provides detection data via a serial port, which can be integrated directly with a controller (discussed below) of robotic submersible 10.

Internal components of robotic submersible 10 are illustrated in FIG. 2. Robotic submersible 10 may be powered by a battery pack 70. For example only, battery 70 may have a capacity of over 700 Watt hours (Wh). Robotic submersible 10 may contain a variety of electronics that are powered by battery 70. Robotic submersible 10 may also be powered by a solar panel 71, a water turbine 72, or any other power generating device (FIG. 3A). Robotic submersible 10 may be powered by each device individually, or may be powered by a combination of devices. For example only, solar panel 71 may generate power that is stored in battery 70, and battery 70 may power robotic submersible 10.

For example only, solar panel 71 may be capable of harvesting solar energy at the order of 20-30 Watts (W) on a sunny day. The power consumption of robotic submersible 10 may be in the range of 5-10 W when robotic submersible 10 is operating in a swimming mode or changing buoyancy/pitch during gliding. Thus, by using solar panel 71, robotic submersible 10 may achieve energetic autonomy with proper power management and motion scheduling.

A controller 73 and a driver 74 control robotic submersible 10 when activated. Controller 73 and driver 74 may each be a printed circuit board (PCB). Controller 73 processes various sensor signals and makes decisions. Driver 74 regulates the voltage from battery 70 and produces appropriate voltage levels for different devices on robotic submersible 10. However, controller 73 and driver 74 could be combined to a single controller that controls all functions of robotic submersible 10, or controller 73 and driver 74 could switch one or more functions to control different parts of robotic submersible 10. Controller 73 and driver 74 control a travel mode of robotic submersible 10 by controlling a center of gravity, a buoyancy, tail 22, and propellers 52.

In some applications, external data collection and control device 64 may further be integrated directly with at least one of controller 73 and driver 74. External data collection and control device 64 may perform high-level computations, such as determining locations of robotic submersible 10 and target environmental features, updating movement modes of robotic submersible 10, updating mission goals, environmental feature location prediction and movement scheduling, and the like. Depending on the availability and quality of cellular data network, external data collection and control device 64 may offload some of the computations to remote storage 66.

At least one of controller 73 and driver 74 control the position of battery 70 along a slide 78 to control the center of gravity. A linear actuator 82 controls the position of battery 70. Linear actuator 82 receives direction from at least one of controller 73 and driver 74 and positions battery 70 along slide 78 accordingly. Use of linear actuator 82 leads to accurate and repeatable placement of battery 70 along slide 78.

At least one of controller 73 and driver 74 control an amount of fluid in a tank 86 to control the buoyancy of robotic submersible 10. A pump 90 pumps the fluid in and out of tank 86 as directed by at least one of controller 73 and driver 74. Fluid enters body 14 through a pumping port 92, travels through pump 90, and into tank 86. Pump 90 may also pump fluid out of tank 86, back through pump 90, and out of pumping port 92 based on direction from at least one of controller 73 and driver 74. Pump 90 may be a self-metering pump that measures the volume (or flow rate) being pumped. Pump 90 may also be a plunger-syringe pumping mechanism. Further, a linear actuator with integrated position feedback (not illustrated) may drive plunger-syringe pumping mechanism 90 to achieve accurate and repeatable results.

Precise buoyancy control is critical to operation of robotic submersible 10 (for example, to maintain neutral buoyancy at any depth). Buoyancy control is realized in general by pumping in or out ambient fluid. Exact buoyancy effect due to the pumped fluid depends on both the volume and density of the fluid. The density could potentially vary with depth and temperature, both of which can be measured with sensors onboard robotic submersible 10—specifically, the depth is measured with a pressure sensor while the temperature is measured with temperature sensor 34. If, for a particular operating environment, the density can be considered constant, then the volume of fluid corresponding to the required buoyancy change may be displaced. When the fluid density is dependent on temperature or depth, the required volume to pump is calculated based on the required buoyancy change and the corresponding density.

At least one of controller 73 and driver 74 controls tail 22 by directing a servo motor 94 engaging the tail 22 with the body 14. Servo motor 94 moves tail 22 in a flapping motion, such that tail 22 laterally pivots at servo motor 94 and propels robotic submersible 10 forward. Servo motor 94 also positions tail 22 to assist in steering robotic submersible 10.

At least one of controller 73 and driver 74 activates propellers 52 on fins 18 (FIG. 3A). Blades 54 rotate about a longitudinal axis (not illustrated) through the center of shaft 58 to propel robotic submersible 10 forward. Propellers 52 assist tail 22 in propelling robotic submersible 10 when additional speed is required.

A micro acoustic modem 95 may be provided to facilitate acoustic communication under water. For example only, micro acoustic modem 95 may be a WHOI Micro-Modem with PSK coding, produced by Woods Hole Oceanographic Institution (WHOI). Micro acoustic modem 95 is electrically connected to, and communicates with, at least one of controller 73 and driver 74. Micro acoustic modem 95 may transmit data and communications with home base 46 and/or remote storage 66. For example only, micro acoustic modem 95 may offer low-power (for example, a transmit power less than 50 W and a receive/idle power less than 0.2 W) and small-footprint option with high-rate (for example, 5 kbps) communication over approximately 2 km. Besides communication, micro acoustic modem 95 may be used for both ranging and underwater navigation with a precision of about 1 m.

A pressure port 96 provides access of the ambient water pressure to a pressure sensor 98. Access is provided through a tube, but could be provided through any passage. The pressure sensor 98 may collect pressure data from within body 14 of robotic submersible 10. Pressure sensor 98 may communicate the data to at least one of controller 73 and driver 74. At least one of controller 73 and driver 74 may interpret the data.

Robotic submersible 10 may operate in a plurality of different operation modes. For example only, robotic submersible 10 may travel in a gliding mode, a swimming mode, a combined gliding and swimming mode, a combined swimming and gliding mode, a propeller mode, or any other travel mode. The center of gravity, buoyancy, tail 22, and propellers 52 assist in transportation of robotic submersible 10 in each of the different operation modes. For example only, robotic submersible 10 may operate at a depth in a range of 0 m to 60 m.

The gliding mode includes rectilinear gliding, or sagittal-plane steady gliding, as adopted by ocean gliders, as well as spiraling, or three-dimensional (3D) spiraling, enabled by gliding with a deflected tail. Gliding utilizes the buoyancy and gravity of robotic submersible 10 to enable motion without any additional propulsion. Robotic submersible 10 adjusts the center of gravity, or pitch adjustment (nose up or nose down), to achieve a certain attitude, which results in glide and horizontal travel.

Robotic submersible 10 may move in three-dimensional space and, by adjusting the tail angle, robotic submersible 10 spirals with different radii and speed. Gliding is energy-efficient, especially when the operational depth is relatively large (greater than a few meters, for example). The speed of robotic submersible 10 during gliding is relatively slow (typically below 0.5 m/s), and thus has limited ability to counteract current or other flow disturbances.

For gliding and spiraling, energy is only consumed when the locomotion profile is changed, and thus the gliding and spiraling operation modes are energy-efficient, especially when the depth of the environment is relatively large (for example, greater than 10 meters). Under gliding, robotic submersible 10 may achieve horizontal travel speeds of up to 0.25 m/s. In spiraling, the turning radius of robotic submersible 10 may be as small as 0.5 m.

The swimming mode includes not only surface swimming, but also three-dimensional swimming underwater. In particular, by maintaining neutral buoyancy, robotic submersible 10 can adjust a nose-up or nose-down attitude (pitch adjustment) for gliding adjustment to swim up or swim down. Further, tail 22 may be used to propel and steer. Robotic submersible 10 may also include at least one pectoral fin (not illustrated) that may be used to propel and steer. Although not illustrated, robotic submersible 10 may have a pair of actively controlled pectoral fins to assist in the swimming mode. The advantages of swimming include being applicable to both shallow and deep environments, high maneuverability, and relatively high speeds (typically up to the order of 1.5 m/s).

The combined gliding and swimming mode combines the gliding mode and the swimming mode, where tail 22 (and/or pectoral fins) flaps with low-to-medium amplitude and frequency during an otherwise normal glide, to boost the speed of gliding-based locomotion. The energy expenditure is more than pure gliding but less than pure swimming.

The combined swimming and gliding mode combines the swimming mode and the gliding mode, where robotic submersible 10 performs a swimming and coasting maneuver. Robotic submersible 10 swims (using the tail 22 and/or pectoral fins) to increase speed, then coasts in a gliding mode, and repeats this pattern. The gliding mode is expected to produce lift and allow robotic submersible 10 to coast for some distance before the speed reaches a lower threshold, indicating returning to movement in swimming mode. The energy expenditure of this mode is less than pure swimming, but the average speed will also be lower.

The propeller mode includes use of propellers 52 on fins 18 of robotic submersible 10. Propellers 52 enhance the capability of robotic submersible 10 to operate in environments with significant ambient flows or disturbances. Examples of these environments include rivers with rapid currents (for example, following a flood) or ocean surfaces. Robotic submersible 10 could operate in propeller mode in tandem with gliding mode and/or swimming mode, to counteract the large disturbances, or robotic submersible 10 may operate exclusively in propeller mode if the working environment has consistent large disturbances. While in propeller mode, robotic submersible 10 is expected to reach a speed up to approximately 2.5 m/s or higher, but the power consumption is also higher than when robotic submersible 10 operates in the other modes. The maneuverability in propeller mode can be enhanced with simultaneous activation of swimming mode.

Figure 4:
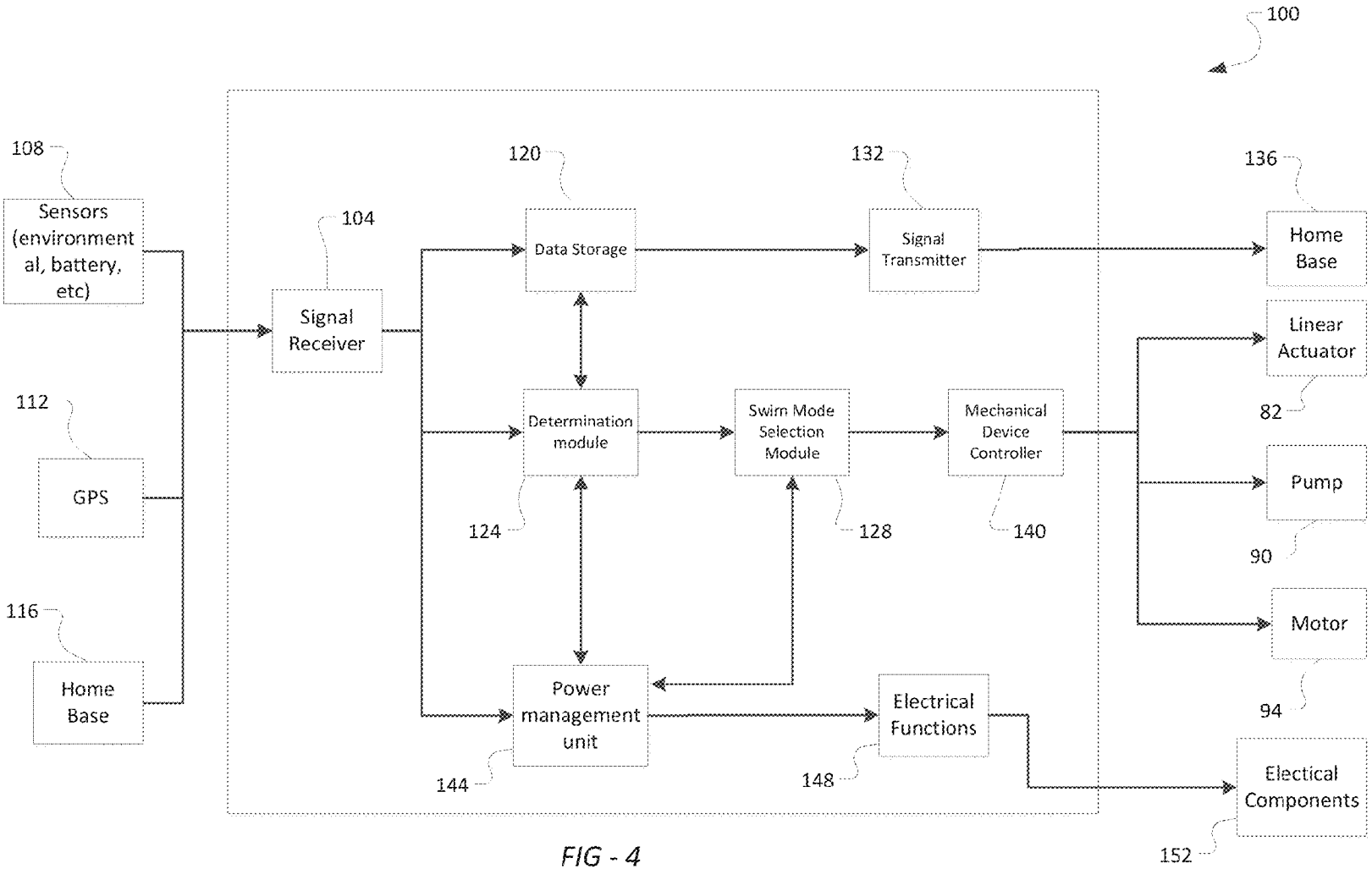
FIG. 4 is a flow diagram showing a control system employed in the robotic submersible of FIG. 1.

Now referring to FIG. 4, robotic submersible 10 may be controlled autonomously. At least one of controller 73 and driver 74 includes a control system 100 for controlling robotic submersible 10. Control system 100 includes a signal receiver 104 that communicates with a plurality of sensors 108. Signal receiver 104 further receives signals from a global positioning system (GPS) 112 and a home base 116.

Signal receiver 104 communicates with a data storage unit or controller 120 (for example only, robotic submersible 10 may include at least 2 GB of onboard data storage). Signal receiver 104 determines the type of data received from sensors 108, GPS 112, and home base 116. If the type of data is a reading for later evaluation, signal receiver 104 transmits the data to data storage unit 120. Data storage unit 120 stores the data until notified by a determination unit 124 that data should be transferred out of data storage 120.

Signal receiver 104 also communicates with determination unit 124. If the type of data is not a reading for later evaluation, signal receiver 104 transmits the data to determination unit 124. Determination unit 124 evaluates the data and determines details about the environment and the state of robotic submersible 10. For example, determination unit 124 determines water depth, required speed, battery charge state, mission urgency, ambient flow disturbance, water density, current buoyancy, required buoyancy, distance to charging station, distance to home base, etc. Determination unit 124 transmits this information to a swim mode selection unit 128.

Water depth may be determined from readings taken by pressure sensor 98, from GPS 26, 112 readings, or any other method. Required speed may be controlled by a user wirelessly sending commands to robotic submersible 10. Required speed may also be determined by control system 100 based on conditions in the fluid environment, determination of mission urgency, or the like.

Battery charge state may be determined based on readings from a sensor, specifically battery charge state may be based on output voltage from battery 70. For example only, in a battery where 18.5 volts (V) is the nominal voltage output, a high battery charge may be 18.5 V or higher; a medium battery charge may be 17 V to 18.5 V, and a low battery charge may be 17 V or lower. However, the high, medium, and low battery charge states may vary based on the type of battery and/or the nominal voltage output.

Mission urgency may be determined by the time frame allotted for the mission. If time is critical to obtain relevant information from the fluid environment, the mission may be considered urgent. For example, for mapping the boundary of an oil spill, time is of the essence since the boundary is continuously expanding or shifting. Therefore, the factors determining urgency include (1) the time scale (how fast the environment is changing) of the evolving information of interest; and (2) whether there is a deadline beyond which the information is of no, or significantly less, value. The mission urgency may be sent wirelessly to robotic submersible 10, or determination unit 124 may determine the mission urgency based on known factors.

Ambient flow disturbance may be determined by the speed of the current. GPS data 112 is taken by GPS receiver 26 on robotic submersible 10 when robotic submersible 10 is idling and drifting with the current. Determination unit 124 may then calculate the ambient flow disturbance using the GPS locations and time. Ambient flow disturbance may also be determined by the magnitude of waves or other turbulences. Data from onboard accelerometers and gyros is collected by signal receiver 104 and used by determination unit 124, along with the time stamp of the data, to calculate ambient flow disturbance. Further, ambient flow disturbance may be determined from any other method.

Precise buoyancy control is critical to the operation of robotic submersible 10 (for example, to maintain neutral buoyancy at any depth). Buoyancy control is realized in general by pumping in/out ambient fluid. Exact buoyancy effect due to the pumped fluid depends on both the volume and density of the fluid. The density could potentially vary with depth and temperature, both of which can be measured with sensors onboard robotic submersible 10. If, for a particular operating environment, the density can be considered constant, then the volume of fluid corresponding to the required buoyancy change may be displaced. When the fluid density is dependent on temperature or depth, the required volume to pump is calculated based on the required buoyancy change and the corresponding density.

Determination unit 124 also communicates with data storage unit 120. If determination unit 124 determines that robotic submersible 10 is within a predetermined distance from the surface of the water (for example, a distance that enables wireless transmission of data), determination unit 124 commands data storage unit 120 to transmit the stored data to a signal transmitter 132. Signal transmitter 132 determines a mode of transmission over which to send the data to a home base 136. The modes of transmission that signal transmitter 132 may select may be wireless transmission, transmission over at least one of a 3G and 4G network, hardwire transmission, or any other transmission method. Home base 136 may be one of a laptop computer, desktop computer, smart phone, or any other device.

Swim mode selection unit 128 determines a mode of transportation of robotic submersible 10. Swim mode selection unit 128 analyzes the water depth, required speed, battery charge state, mission urgency, ambient flow disturbance, water density, current buoyancy, required buoyancy, distance to charging station, distance to home base, etc., transmitted from determination unit 124. A plurality of factors may be used to determine which locomotion mode to use and when to switch between locomotion modes: Operating depth, level of ambient flow disturbance, battery charge level, mission nature (urgent/non-urgent), and speed required by mission (fast or flexible). Mission urgency may be determined by (1) the time scale (how fast the environment is changing) of the evolving information of interest and (2) whether there is a deadline beyond which the information is of no, or significantly less, value.

For example, if operating depth is below a first predetermined depth threshold (for example, less than 1 meter), glide mode is not desirable since the energy saved during gliding will not be justified by the cost in initiating gliding up and gliding down (in particular, buoyancy adjustment). Instead, swimming mode may be selected. If the mission is urgent (for example only, the environment is rapidly changing or the information is time sensitive), the battery charge level is high (for example only, in an 18.5 V system, the charge level is greater than or equal to 18.5 V), and the speed required is fast (for example only, in an 18.5 V system, greater than 0.5 m/s), robotic submersible 10 may only operate in swimming mode. If the mission is non-urgent, the speed required is flexible (for example only, less than 0.5 m/s), or the battery charge level is between medium and high (for example only, in an 18.5 V system, within the range of 17 V to 18.5 V), the combined swimming and gliding mode may be selected.

Further examples of the plurality of factors used to determine locomotion modes include: If operating depth is greater than a second predetermined depth threshold (for example only, greater than 3 meters), and if the level of ambient flow disturbance is less than a first predetermined threshold (for example, less than 0.2 m/s), robotic submersible 10 may operate in gliding mode. If operating depth is greater than the second predetermined depth threshold, and if the level of ambient flow disturbance is greater than the first predetermined threshold but less than a second predetermined threshold (for example, 0.2-0.5 m/s), robotic submersible 10 may operate in combined gliding and swimming mode. If operating depth is greater than the second predetermined depth threshold, and if the level of ambient flow disturbance is greater than the second predetermined threshold but less than a third predetermined threshold (for example, 0.5-1 m/s), robotic submersible 10 may operate in swimming mode. If the level of ambient flow disturbance is greater than the third predetermined threshold (for example, greater than 1 m/s), and if the battery charge level is high (for example only, in an 18.5 V system, at least 18.5 V), robotic submersible 10 may operate in propeller mode. If the battery charge level is low (for example only, in an 18.5 V system, less than 17 V), robotic submersible 10 may enter emergency modes.

In other words, if the water depth is less than a predetermined level (for example only, less than 1 meter), or, if the water depth is greater than the predetermined level, the required speed is faster than a predetermined speed (for example only, 0.5 m/s), the mission is urgent, and the battery charge level is high, swim mode selection unit 128 will select operation in a swimming mode. If the water depth is greater than the predetermined level, and at least one of the required speed is less than the predetermined speed, the mission is not urgent, and the battery charge level is not high, swim mode selection unit 128 will select operation in the combined swimming and gliding mode. If the battery charge level is below the medium charge level, swim mode selection unit 128 will select operation in the emergency power management mode. Swim mode selection unit 128 may select operation in the glide mode if the water depth is greater than a second predetermined level (for example only, greater than 3 meters) and the ambient flow disturbance is below a first predetermined threshold (for example only, 0.2 m/s). Swim mode selection unit 128 may select operation in the combined gliding and swimming mode if the water depth is greater than the second predetermined level and the ambient flow disturbance is below a second predetermined threshold (for example only, 0.5 m/s). Swim mode selection unit 128 may select operation in swim mode if the water depth is greater than the second predetermined level and the ambient flow disturbance is below a third predetermined threshold (for example only, 1.0 m/s). If the ambient flow disturbance is above the third predetermined threshold and the battery charge level is above a first predetermined threshold (for example only, in an 18.5 V system, 18.5 V), swim mode selection unit 128 may select operation in propeller mode, and if the ambient flow disturbance is above the third predetermined threshold and the battery charge level is above a second predetermined threshold (for example only, in an 18.5 V system, 17 V), swim mode selection unit 128 may select operation in the combined swimming and gliding mode.

Swim mode selection unit 128 may use open-loop control, closed-loop control, or hybrid control to select and control each of the locomotion modes. For open-loop control, the control inputs (for example, the pumping rate/timing, movable mass displacement, fin movement, propeller speed, etc.) are predetermined based on the planned course and the locomotion mode. Open-loop control may be used if the environment is well characterized with little uncertainty (for example, a calm lake environment).

In closed-loop control, the control inputs are computed based on the sensory feedback (for example, GPS and inertial sensors), to compensate for errors between desired trajectories/attitudes and measured/estimated values. Specific closed-loop controllers can range from simple proportional-integral-derivative (PID) controllers to more advanced nonlinear controllers such as passivity-based controllers or sliding mode controllers. Closed-loop control may be used if the environment is very uncertain.

For hybrid control, the control inputs are determined through a supervisory control architecture. By default, the control inputs are determined with open-loop control, while the system outputs (robotic submersible position and attitude trajectory and/or other states such as linear or angular velocities) are being monitored. If the error between the desired and actual system outputs exceeds a predetermined level, robotic submersible 10 enters the hybrid control mode, where the control inputs are obtained by combining the open-loop, control-based, predetermined values with feedback terms computed with closed-loop control methods. This approach is applied in an environment that has low-to-moderate uncertainties. Compared to open-loop control, hybrid control has corrective power in response to environmental disturbances. Comparing to closed-loop control, hybrid control does not require feedback all the time, and if or when it does, the feedback effort is less than what is needed in closed-loop control due to the feedforward component from the open-loop control component.

Swim mode selection unit 128 transmits the selected mode of transportation to a mechanical device controller 140. Mechanical device controller 140 determines the amount of water needed to pump into or out of pump tank 86, the movement of battery 70 for center of gravity, and the operation and speed that tail 22 moves to swim. Mechanical device controller 140 selectively controls linear actuator 82, pump 90, and motor 94 to achieve the selected mode of transportation.

A power management unit 144 receives data from signal receiver 104 and communicates with determination unit 124, swim mode selection unit 128, and an electrical functions module 148 which enables/disables electrical components 152 on robotic submersible 10. Power management unit 144 implements an intelligent power management scheme to maximize the operational duration of robotic submersible 10 and survivability under unexpected situations. There are multiple sources of energy expenditure that drain the battery power at different rates, such as actuation for achieving locomotion (for example, gliding and swimming), environmental and inertial sensing, wireless communication, and other onboard information processing. There are also multiple ways of charging the batteries and/or harvesting ambient energy, such as wired charging, wireless charging (for example, inductive charging), using solar cells, and harvesting wave energy (for example, using smart material transducers or exploiting capacitance change associated with robot movements under wave influences). Wired or wireless charging can only take place at certain charging stations but are more predictable in terms of the energy input, while solar and wave energy harvesting can be activated all the time but are less predictable.

Power management unit 144 makes decisions to coordinate the energy draining/supplying operations. The charge level of battery pack 70 is monitored through, for example, the voltage output of the batteries. Multiple emergency threshold levels for the battery status are set and corresponding actions are taken for each threshold level. For example only, a first predetermined charge threshold (below which only limited locomotion is possible), a second predetermined charge threshold (below which any locomotion should be suspended), a third predetermined charge threshold (below which environmental sensing and non-essential inertial sensing should be suspended), and a fourth predetermined charge threshold (below which only the vital functions of the microcontroller are maintained) may influence the operating modes of robotic submersible 10.

If the battery charge level drops below the first predetermined charge threshold (for example only, 17 V when the nominal voltage of the battery is 18.5 V), robotic submersible 10 enters a first-level emergency mode: (1) immediately pumping out fluid to ascend to the surface, (2) wirelessly reporting the emergency mode and GPS coordinates, and (3) estimating a feasibility to swim back to a wired or wireless charging station based on the distance to the closest (or most feasible) station. If the battery charge level drops below the second predetermined charge threshold (for example only, 16V when the nominal voltage of the battery is 18.5 V), or when the charge level is between the first predetermined charge threshold and the second predetermined charge threshold, but robotic submersible 10 cannot safely return to any of the wired or wireless charging stations, robotic submersible 10 enters a second-level emergency mode: freeze all locomotion operations (for example, gliding or swimming), but maintain all environmental or navigational sensing operations as well as wireless communication. If the battery charge level drops below the third predetermined charge threshold (for example only, 15 V when the nominal voltage of the battery is 18.5 V), robotic submersible 10 enters a third-level emergency mode: all sensing functions except GPS are turned off, and robotic submersible 10 communicates with home base 46 (or the rest of the network) at a much lower rate about the emergency status and GPS coordinates. If the battery charge level drops below the fourth predetermined charge threshold (for example only, 14 V when the nominal voltage of the battery is 18.5 V), robotic submersible 10 enters a fourth-level emergency mode: GPS function and wireless communication are disabled, enabling only the basic functions of the onboard processor (coordinating the energy-harvesting mechanisms and monitoring the battery charge level). If the battery charge level rises back with the harvested energy, robotic submersible 10 resumes its suspended functions, corresponding to its current battery charge level and emergency mode. In particular, when the battery charge level is above the first predetermined charge threshold, robotic submersible 10 fully resumes all intended operations.

To avoid "chattering" between different emergency modes, a hysteresis mechanism is implemented for switching between the modes. The hysteresis mechanism operates similar to a thermostat (for example, if you want to maintain a room temperature at about 75 degrees, you do not turn on the heater until it falls under 74 degrees and do not turn on the AC until it rises above 76 degrees). For example only, the hysteresis mechanism may implement a 0.2 V hysteresis on each voltage threshold to avoid unnecessary switching between different emergency modes. Further, the energy-scavenging and wired/wireless charging circuits may all operate simultaneously.

Figure 5:
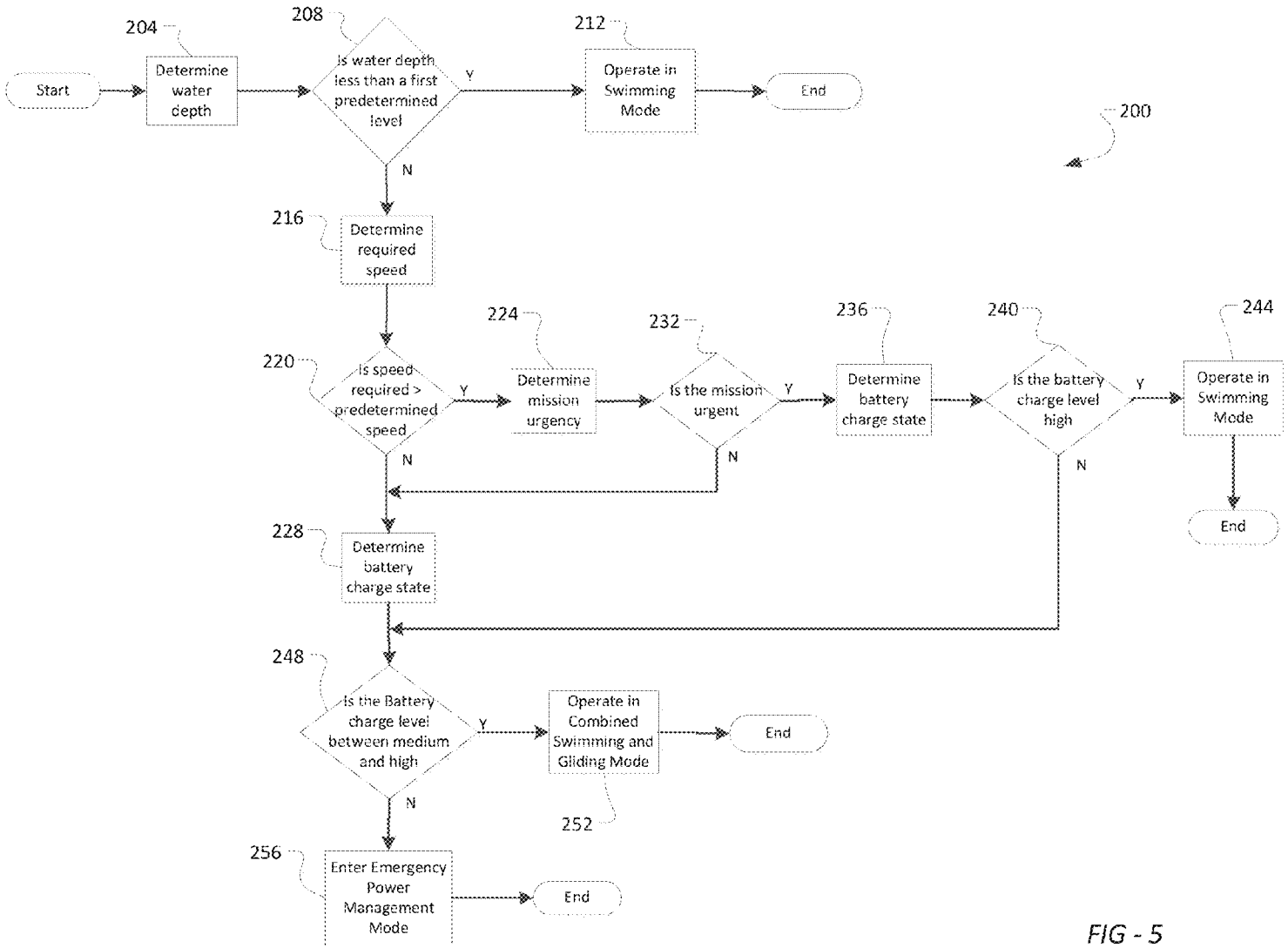
FIG. 5 is a flow diagram illustrating a method for controlling the robotic submersible according to the present disclosure.

A method 200 for controlling robotic submersible 10 is illustrated in FIG. 5. Method 200 determines the water depth at step 204, where the water depth may be determined from sensor data and/or GPS data. Method 200 determines whether the water depth is less than a first predetermined level at step 208. For example, the first predetermined level may be 1 meter; however, the first predetermined level may be determined based on capabilities of robotic submersible 10 and may be larger or smaller depending on the requirements of the mission. If the water depth is less than the first predetermined level, method 200 directs robotic submersible 10 to operate in swimming mode at step 212. If the water depth is greater than the first predetermined level, method 200 determines the required speed of robotic submersible 10 for the current mission at step 216.

At step 220, method 200 determines if the required speed is faster than a predetermined speed threshold. For example, the predetermined speed threshold may be 0.5 m/s. However, the first predetermined speed threshold may be determined based on capabilities of robotic submersible 10 and may be larger or smaller depending on the requirements of the mission. If the required speed is faster than the predetermined speed threshold, method 200 determines the mission urgency at step 224. If the required speed is not faster than the predetermined speed threshold, method 200 determines the battery charge state at step 228.

At step 232, method 200 determines whether the mission is urgent. The mission may be urgent if the fluid environment is changing with time or if there is a deadline beyond which the information is of no, or significantly less, value. If the mission is urgent, method 200 determines the battery charge state at step 236. If the mission is not urgent, method 200 determines the battery charge state at step 228.

At step 240, method 200 determines whether the battery charge level is high. For example, where the nominal voltage of the battery is 18.5 volts (V), the battery charge level may be high if the battery charge is 18.5 V or higher. If the battery charge level is high at step 240, method 200 directs robotic submersible 10 to operate in swimming mode at step 244. If the battery charge level is not high at 240, method 200 determines whether the battery charge level is between medium and high at step 248. For example, where the nominal voltage of the battery is 18.5 volts (V), the battery charge level may be between medium and high if the battery charge is within a range of 17 V to 18.5 V.

If the battery charge level is between medium and high at step 248, method 200 instructs robotic submersible 10 to operate in combined swimming and gliding mode at step 252. If the battery charge level is not between medium and high at step 248, method 200 instructs robotic submersible 10 to enter emergency power management mode at step 256.

Controller 100 includes computer software stored in non-transitory computer memory having a set of instructions for operably controlling the movement mode of robotic submersible 10. The computer software further includes sets of instructions for operably determining the depth of robotic submersible 10 within a fluid environment, the required speed for robotic submersible 10, and the battery charge. The computer software bases the movement mode selection on the required speed, depth, and battery charge.

Figure 6:
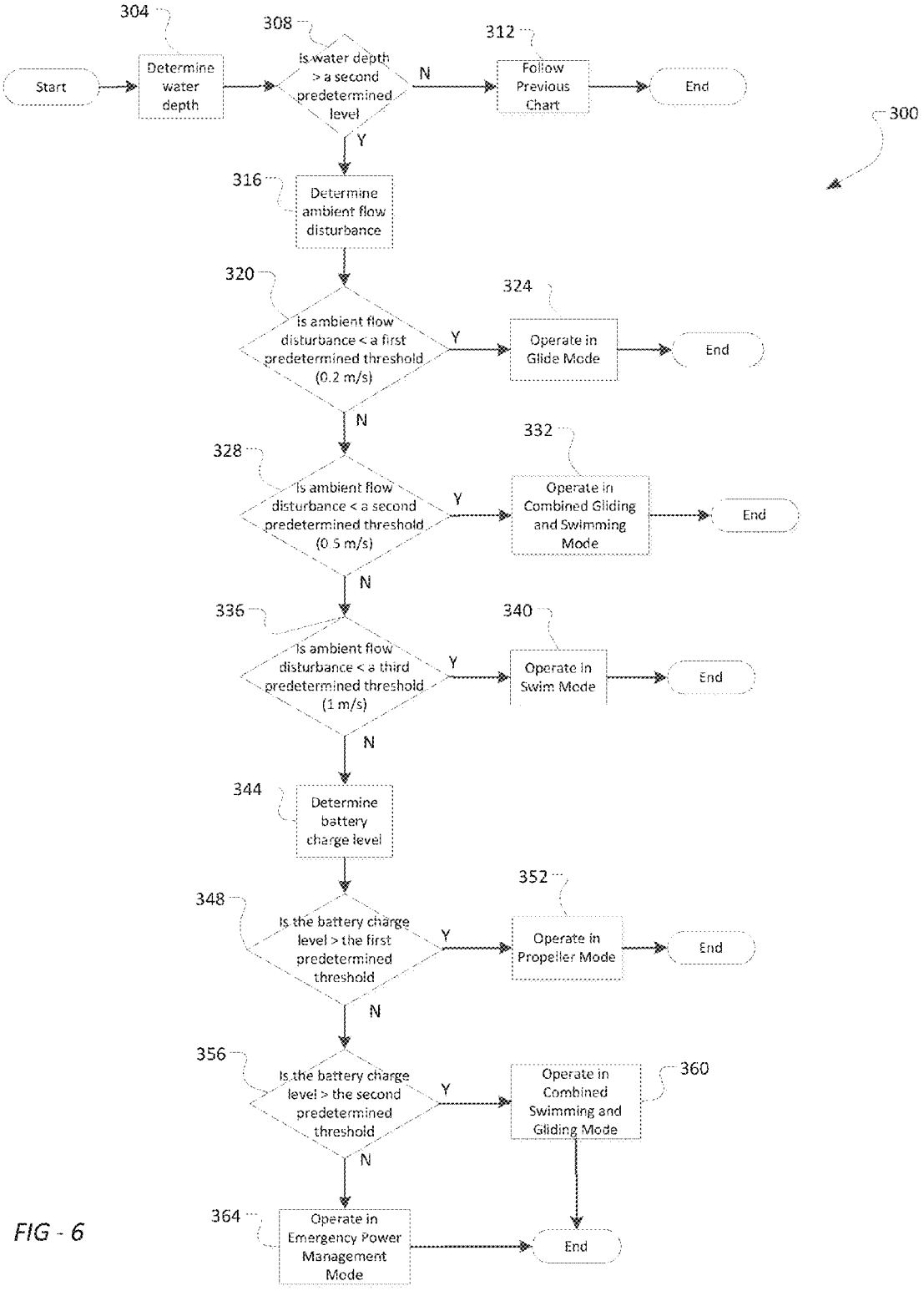
FIG. 6 is a flow diagram illustrating another method for controlling the robotic submersible according to the present disclosure.

A method 300 for controlling robotic submersible 10 is illustrated in FIG. 6. Method 300 determines the water depth at step 304. The water depth may be determined from the sensor data and the GPS data. Method 300 determines whether the water depth is greater than a second predetermined level at step 308. The second predetermined level may be 3 meters. However, the second predetermined level may be determined based on capabilities of robotic submersible 10 and may be larger or smaller depending on the requirements of the mission. If the water depth is less than the second predetermined level, method 300 directs robotic submersible 10 to follow method 200 for controlling robotic submersible 10 at step 312. If the water depth is greater than the second predetermined level, method 300 determines the ambient flow disturbance at step 316. The ambient flow disturbance may be determined by the speed of the current (using GPS receiver data) or the magnitude of waves or other turbulences (using accelerometer or other gyro data).

At step 320, method 300 determines whether the ambient flow disturbance is below a first predetermined threshold. For example, the first predetermined threshold may be 0.2 m/s. However, the first predetermined threshold may be determined based on capabilities of robotic submersible 10 and may be larger or smaller depending on the requirements of the mission. If true at step 320, method 300 directs robotic submersible 10 to operate in the glide mode at step 324. If false at step 320, method 300 determines whether the ambient flow disturbance is below a second predetermined threshold at step 328. For example, the second predetermined threshold may be 0.5 m/s. However, the second predetermined threshold may be determined based on capabilities of robotic submersible 10 and may be larger or smaller depending on the requirements of the mission.

If true at step 328, method 300 directs robotic submersible 10 to operate in the combined gliding and swimming mode at step 332. If false at step 328, method 300 determines whether the ambient flow disturbance is below a third predetermined threshold at step 336. The third predetermined threshold may be 1.0 m/s. However, the third predetermined threshold may be determined based on capabilities of robotic submersible 10 and may be larger or smaller depending on the requirements of the mission.

If true at step 336, method 300 directs robotic submersible 10 to operate in the swim mode at step 340. If false at step 336, method 300 determines the battery charge level at step 344. The battery charge level may be determined by sensor readings detailing the output voltage of battery 70.

At step 348, method 300 determines whether the battery charge level is above a first predetermined threshold (for example only, 18.5V where the nominal voltage of the battery is 18.5 V). If true at step 348, method 300 directs robotic submersible 10 to operate in the propeller mode at step 352. If false at step 348, method 300 determines whether the battery charge level is above a second predetermined threshold (for example only, 17 V where the nominal voltage of the battery is 18.5 V) at step 356.

If true at step 356, method 300 directs robotic submersible 10 to operate in the combined swimming and gliding mode at step 360. If false at step 356, method 300 directs robotic submersible 10 to operate in the emergency power management mode at step 364.

Controller 100 includes computer software stored in non-transitory computer memory having a set of instructions for operably controlling the movement mode of robotic submersible 10. The movement mode is influenced by the battery charge level and varies based on whether the battery charge level is greater than the first predetermined threshold or the second predetermined threshold.

Figure 7:
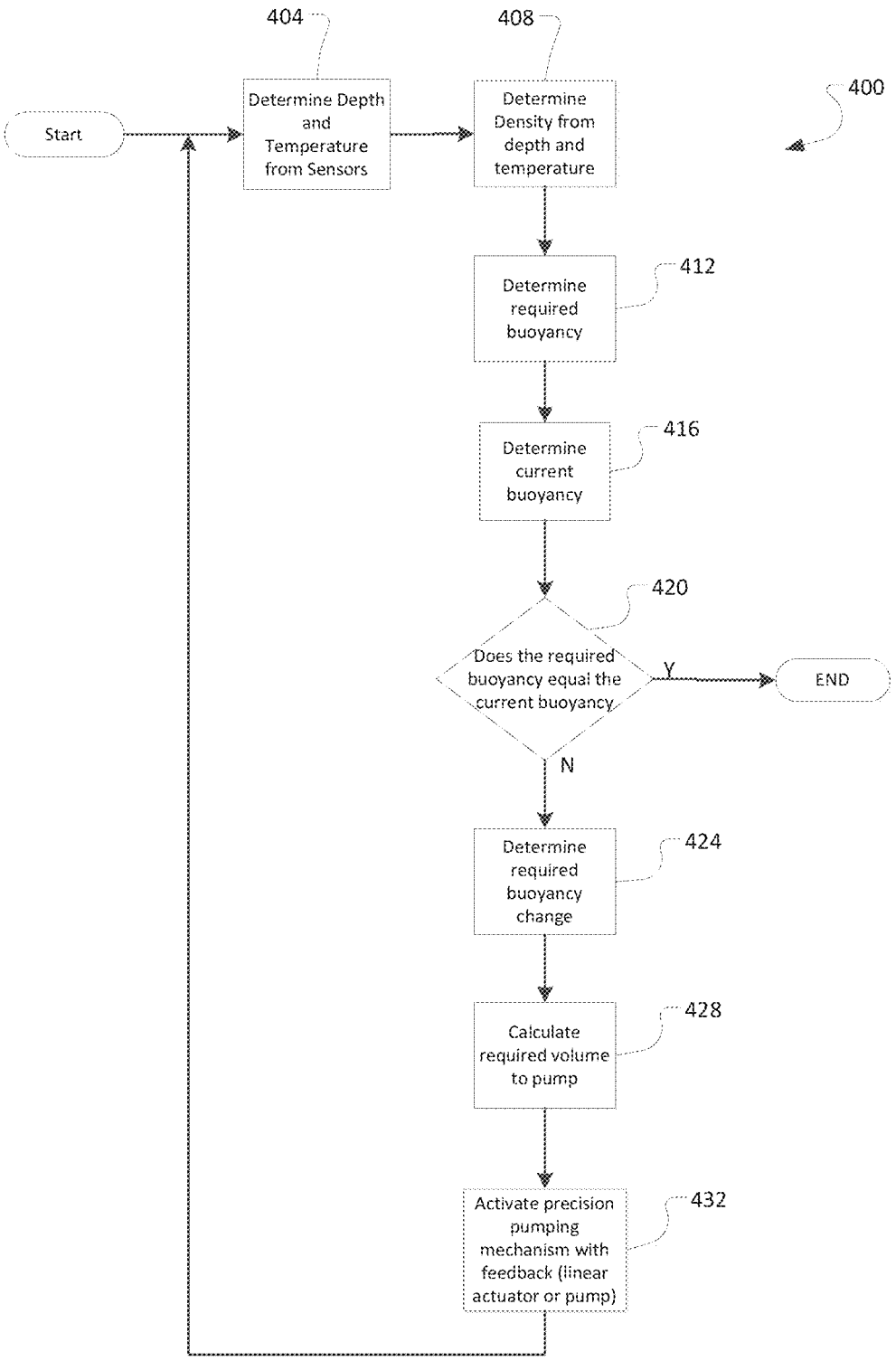
FIG. 7 is a flow diagram illustrating another method for controlling the robotic submersible according to the present disclosure.

A method 400 for controlling robotic submersible 10 is illustrated in FIG. 7. Method 400 determines a depth and a temperature from sensor readings at step 404. Depth may be measured with a pressure sensor and temperature may be measured from a temperature sensor. At step 408, method 400 determines density from depth and temperature. At step 412, method 400 determines a required buoyancy for robotic submersible 10. The required buoyancy may be mission specific and may be determined based on the architecture of robotic submersible 10, the environmental conditions for the specific mission, and the requirements of the mission. At step 416, method 400 determines a current buoyancy of robotic submersible 10. For example only, the current buoyancy may be determined by readings from pressure sensor 98 and a temperature sensor within housing 24. At step 420, method 400 determines whether the required buoyancy equals the current buoyancy. If true, method 400 ends.

If false at step 420, method 400 determines the required buoyancy change at step 424. At step 428, method 400 calculates a required volume of fluid that must be pumped in or out of tank 86. For example only, the required volume may be calculated by using the known buoyancy of robotic submersible 10, and the readings of temperature sensor 34 and a pressure sensor on the housing 24. At step 432, method 400 activates a precision pumping mechanism to pump the required volume. For example only, the precision pumping mechanism may be a linear actuator, a pump, or any other pumping mechanism known in the art. Method 400 then determines the depth and temperature of robotic submersible 10 from sensor readings at step 404.

Controller 100 includes computer software stored in non-transitory computer memory having a set of instructions for operably controlling the buoyancy. The software includes sets of instructions for determining the density of the fluid environment, determining the current and required buoyancy, and determining the buoyancy change. Instructions for determining the required volume to pump in or out of tank 86, activating the precision pumping mechanism, and monitoring the required and current buoyancies as a feedback mechanism are also included in the computer software.

Figure 8:
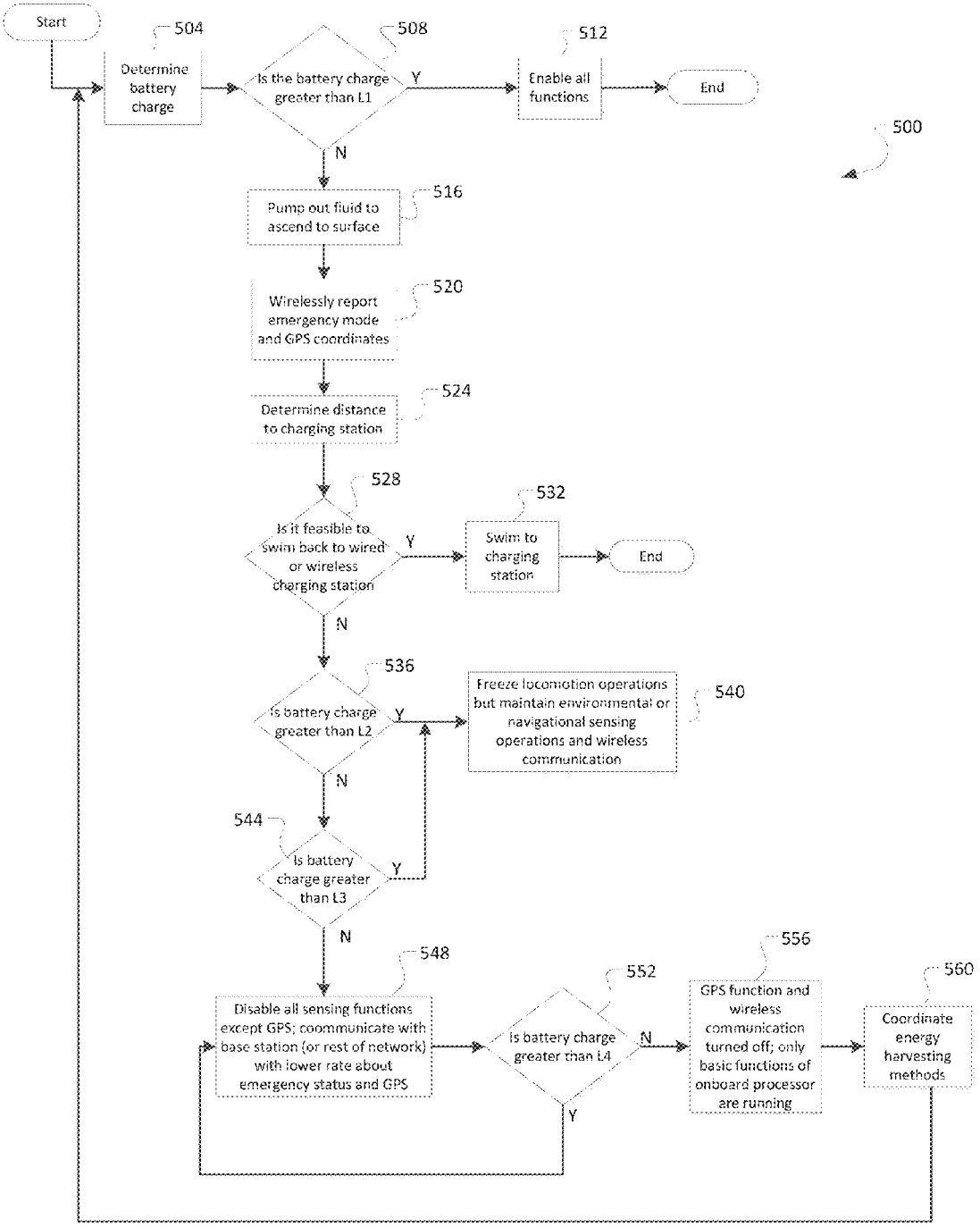
FIG. 8 is a flow diagram illustrating another method for controlling the robotic submersible according to the present disclosure.

A method 500 for controlling robotic submersible 10 is illustrated in FIG. 8. Method 500 determines a battery charge at step 504. Controller 100 includes computer software stored in non-transitory computer memory having a set of instructions for operably monitoring the battery charge. At step 508, method 500 determines whether the battery charge is greater than a first predetermined charge threshold (for example only, 17 V when the nominal voltage is 18.5 V). If true, method 500 enables all functions of robotic submersible 10 at step 512.

If false at step 508, method 500 pumps fluid out of the tank, allowing robotic submersible 10 to ascend to the surface of the water at step 516. At step 520, method 500 wirelessly reports an emergency mode and global positioning (GPS) coordinates to home base 46. At step 524, method 500 determines the distance to the charging station. For example only, the distance may be determined from the GPS coordinates of home base 46 and the GPS coordinates of robotic submersible 10.

At step 528, method 500 determines whether it is feasible to swim back to a wired charging station or within a territory of a wireless charging station. If true, method 500 directs robotic submersible 10 to swim to the charging station at step 532. If false at step 528, method 500 determines whether the battery charge is greater than a second predetermined charge threshold (for example only, 13 V when the nominal voltage is 18.5 V). If true, method 500 freezes locomotion operations but maintains environmental and navigational sensing operations and wireless communications at step 540.

If false at step 536, method 500 determines whether the battery charge is greater than a third predetermined charge threshold (for example only, 10 V when the nominal voltage is 18.5 V) at step 544. If true, method 500 freezes locomotion operations but maintains environmental and navigational sensing operations and wireless communications at step 540. If false at step 536, at step 548, method 500 disables all sensing functions except emergency status and GPS communication with the base station (or the remainder of the network) at a lower communication rate.

At step 552, method 500 determines whether the battery charge is greater than a fourth predetermined charge threshold (for example only, 6 V when the nominal voltage is 18.5 V). If true, at step 548, method 500 disables all sensing functions except emergency status and GPS communication with the base station (or the remainder of the network) at a lower communication rate. If false at step 552, at step 556, method 500 disables GPS function and wireless communication, leaving enabled only basic functions of onboard microprocessor.

At step 560, method 500 coordinates energy harvesting methods. For example only, the energy harvesting methods may include solar power, wireless charging (for example, inductive charging), using solar cells, and harvesting wave energy (for example, using smart material transducers or exploiting capacitance change associated with robotic movements under wave influences). At step 504, method 500 determines the battery charge and cycles through the steps again until either all functions are enabled at step 512, or robotic submersible 10 swims to a charging station at step 532.

Figure 9:
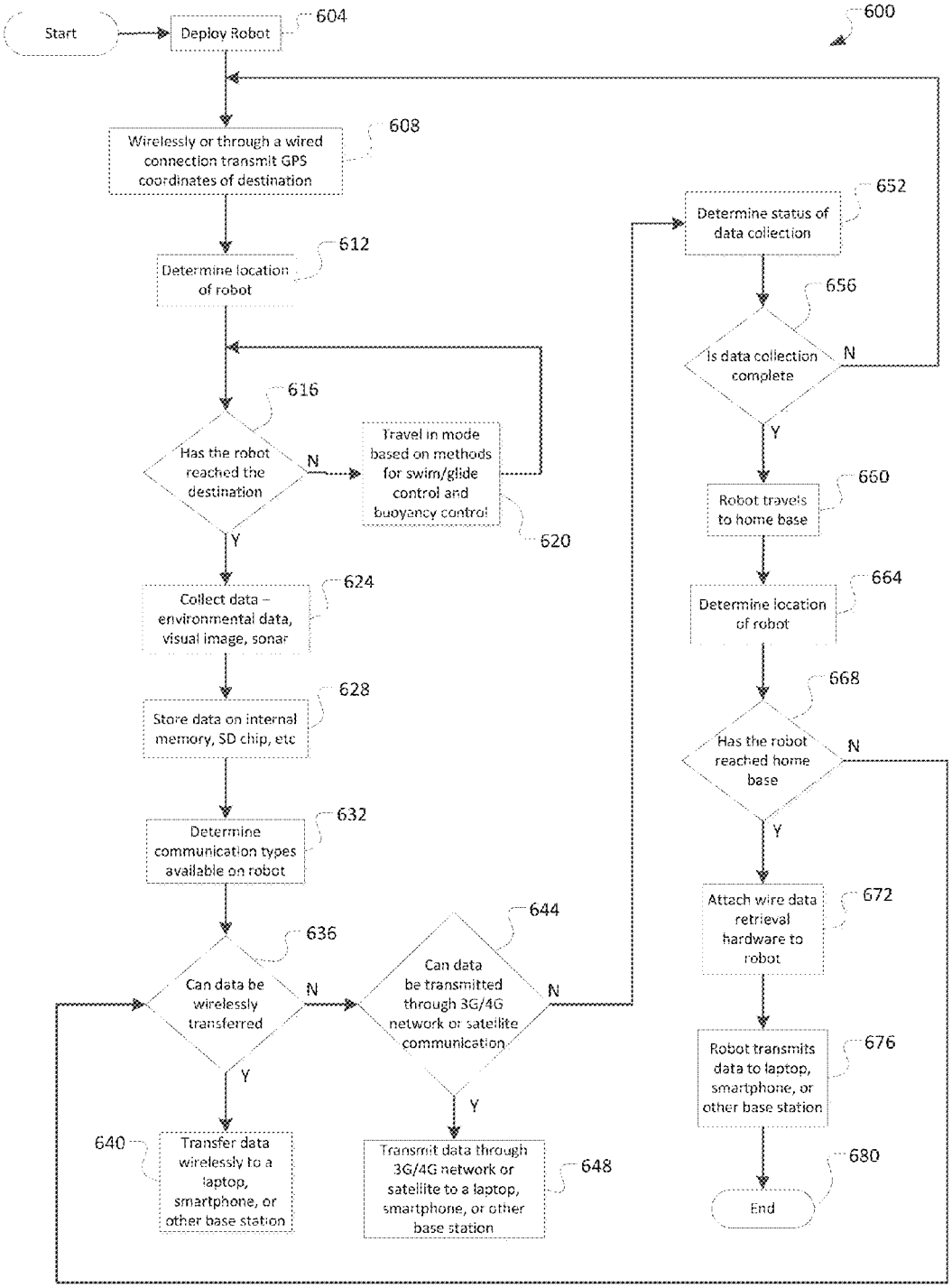
FIG. 9 is a flow diagram illustrating another method for controlling the robotic submersible according to the present disclosure.

A method 600 for controlling robotic submersible 10 is illustrated in FIG. 9. Method 600 deploys robotic submersible 10 at step 604. Robotic submersible 10 may be deployed from home base 46 or from another location. At step 608, method 600 wirelessly, or through a wired connection, transmits GPS coordinates of a destination from home base 46 to robotic submersible 10. At step 612, method 600 determines the current GPS location of robotic submersible 10. The GPS location of robotic submersible 10 may be determined from GPS coordinates collected by GPS receiver 26. At step 616, method 600 determines whether robotic submersible 10 has reached the destination. For example only, if the GPS coordinates of the destination are the same as the GPS coordinates of the location of robotic submersible 10, then robotic submersible 10 has reached the destination. If false at step 616, method 600 directs robotic submersible 10 to travel in a mode based on methods 400, 300, and 200 at step 620 and then rechecks whether robotic submersible 10 has reached the destination at step 616.

If true at step 616, method 600 collects data at step 624. Data collected may include at least one of environmental data, visual image data, and sonar data. At step 628, method 600 stores the data collected. For example, the collected data may be stored on an internal memory chip, an SD chip, removable memory card, a disc, or any other memory. At step 632, method 600 determines the communication methods available for robotic submersible 10. The availability of the difference communication methods may be dependent on the location, depth, and environmental conditions of robotic submersible 10. At step 636, method 600 determines whether the data can be wirelessly transferred. If true, method 600 transfers the data wirelessly to a laptop computer, desktop computer, smartphone, or any other home base at step 640.

If false at step 636, method 600 determines whether data can be transmitted through at least one of a 3G or 4G network or satellite communication at step 644. If true, method 600 transfers the data through 3G or 4G network or satellite to the laptop computer, desktop computer, smartphone, or any other home base at step 648.

If false at step 644, method 600 determines the status of the data collection at step 652. The status of the data collection is mission dependent and may be based on the goal of the mission. At step 656, method 600 determines whether data collection is complete. For example only, data collection is complete when robotic submersible 10 has completed the path specified by a user (for example, if the application is to map out the concentration field of oil spill or harmful algae), or when a specific goal has been achieved (for example, if the application is to locate a source of spill or a hydrothermal vent). If false at step 656, method 600 wirelessly, or through a wired connection, transmits GPS coordinates of a destination from home base 46 to robotic submersible 10 at step 608. If true at step 656, method 600 directs robotic submersible 10 to travel to home base 46 at step 660.

At step 664, method 600 determines the location of robotic submersible 10. The location of robotic submersible 10 may be determined from GPS coordinates collected by GPS receiver 26. At step 668, method 600 determines whether robotic submersible 10 has reached home base 46. For example only, if the GPS coordinates of home base 46 are the same as the GPS coordinates of the location of robotic submersible 10, then robotic submersible 10 has reached home base 46.

If false at step 668, method 600 returns to step 636 and determines whether the data can be transferred wirelessly. If true at step 668, method 600 instructs a user to attach wire data retrieval hardware to robotic submersible 10 at step 672. The wire data retrieval hardware may include any wired hardware used to retrieve data from robotic submersible 10, such as a universal serial bus (USB) cord. At step 676, method 600 directs robotic submersible 10 to transmit data to the laptop computer, desktop computer, smartphone, or any other home base 46. Method 600 ends at step 680.

Controller 100 includes computer software stored in non-transitory computer memory having a set of instructions for operably collecting data using sensors and operably transmitting the data to home base 46, wherein the mode of transmission is based at least on the battery charge and the GPS location.

While the uses for robotic submersible 10 are endless, robotic submersible 10 may be used to monitor the structural parameters of underwater bridge foundations, or bridge scour monitoring (an important issue in bridge safety). Scour refers to the wash-away of bridge foundation materials by river current (especially after flooding). Current methods of measuring bridge scour are either manual (labor intensive) or using fixed instrumentation (expensive to deploy). With robotic submersible 10, a depth sonar (also known as sonar altimeter) can measure the distance between the water surface and the riverbed at multiple locations around bridge piers. Scour is calculated based on the distance measurement and the water level information (the latter info can be obtained from near real-time data from the United States Geological Survey (USGS), installed water level sensors on each bridge, or estimation with an onboard camera). One robotic submersible can be used to monitor scour at multiple piers. Information gathered by robotic submersible 10 can be (1) stored onboard and retrieved at a later time, (2) wirelessly transmitted to a nearby laptop, smartphone, or other base station, or home base, that is monitored by an operator, or (3) transmitted through internet, 3G or 4G network, or satellite communication to a remote site.

Robotic submersible 10 can also be used to monitor the integrity of bridge foundations and structures with camera or sonar-based imaging. Robotic submersible 10 dives underwater and collects images (visual or sonar) in the environment generally adjacent to the bridge foundation or structure. These images will be stored onboard (for example, using an SD card) until robotic submersible 10 surfaces, when the images will be retrieved directly or transmitted wirelessly to a user.

Robotic submersible 10 may be configured to accept different types of sensors. Robotic submersible 10 may autonomously adapt its buoyancy and center of gravity settings to new sensors to enable a single robotic submersible to be used to monitor different environments or gather different types of data. Thus, robotic submersible 10 is highly adaptable and may be used for a variety of different tasks and in a variety of different environments.

While robotic submersible 10 is illustrated as having two fins 18, it is contemplated that robotic submersible 10 could have any number of fins to assist in swimming, gliding, steering, or any other function of robotic submersible 10. Robotic submersible 10 may further have more than one motor to activate one or more fins (including using two or more motors for only one fin or tail). The additional motors and/or fins may assist in propulsion of robotic submersible 10 and may assist in enabling robotic submersible 10 to travel at faster speeds or more maneuverability.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of controlling a robotic submersible comprising:

monitoring a battery charge state;

controlling a movement mode, wherein the movement mode is influenced by the battery charge state;

controlling a buoyancy;

collecting data using a plurality of sensors; and transmitting the data to an external home base, wherein a mode of transmission is based at least on the battery charge state and a location;

wherein if a depth of the submersible in water is greater than a predetermined level, an ambient flow disturbance is greater than a predetermined threshold, and the battery charge state is above a predetermined state, the movement mode is a propeller mode.

2. The method of claim 1, wherein the movement mode is at least one of a swim mode, a glide mode, a propeller mode and any combination thereof.

3. The method of claim 2, wherein when the movement mode is the swim mode or a combination including the swim mode, further comprising adjusting a center of gravity and activating a motor that moves a tail relative to a body.

4. The method of claim 2, wherein when the movement mode is the glide mode or a combination including the glide mode, further comprising adjusting the buoyancy by pumping fluid in or out of a tank and adjusting a center of gravity by positioning a battery along a slide.

5. The method of claim 2, wherein when the movement mode is the propeller mode or a combination including the propeller mode, further comprising activating at least one propeller on at least one fin.

6. The method of claim 1, wherein the movement mode is further influenced by at least one of water depth, mission urgency, and ambient flow disturbance.

7. The method of claim 1, further comprising:

autonomously selecting the movement mode based on a required speed, a depth of the submersible in water and the battery charge state;

the movement mode being at least one of: a swimming mode, a gliding mode, a propeller mode, a combined swimming and gliding mode, a combined gliding and swimming mode, and any combination thereof; and autonomously selectively controlling at least two of: a propeller, a buoyancy, and a center of gravity, to achieve the movement mode.

8. The method of claim 1, further comprising using a controller to determine whether a mission is urgent, and using the urgency determination to select the movement mode, and the mission being defined as urgent if a time for completion is less than a predetermined time threshold.

9. The method of claim 8, wherein if a depth of the submersible in water is greater than a predetermined level, the battery charge state is between medium and high, a required speed is slower than a predetermined speed and the mission is not urgent, the movement mode is a combined swimming and gliding mode.

10. The method of claim 9, wherein if the depth is greater than the predetermined level, the battery charge state is below medium, the required speed is slower than the predetermined speed and the mission is not urgent, the movement mode is an emergency power management mode.

11. The method of claim 1, further comprising moving a battery within the submersible to change a center of gravity of the submersible.

12. The method of claim 1, further comprising monitoring a structural parameter of an underwater foundation and wirelessly transmitting information about the structural parameter monitored to a remote receiver.

13. The method of claim 1, further comprising monitoring a water quality condition and wirelessly transmitting information about the water quality condition monitored to a remote receiver.

14. The method of claim 1, further comprising pivoting a tail fin with an actuator to propel the submersible at a speed of 1.5 m/s or less, with a power consumption of 5-10 W when the tail fin is pivoting, and the submersible weighs no more than 15 kg.

15. Computer software stored in non-transitory computer memory, the software comprising:

a first set of instructions operably monitoring a battery charge state of an autonomously controlled submersible;

a second set of instructions operably controlling a movement mode, wherein the movement mode is influenced by the battery charge state;

a third set of instructions operably controlling a buoyancy;

a fourth set of instructions operably collecting data using a plurality of sensors; and a fifth set of instructions operably transmitting the data to an external home base, wherein a mode of transmission is based at least on the battery charge state and a location;

wherein if a depth of the submersible in water is greater than a first predetermined level, the battery charge state is below medium, and a required speed is slower than a predetermined speed and the mission is not urgent, the movement mode is an emergency power management mode.

16. The computer software of claim 15, wherein:

at least the second set of instructions determines whether a mission is urgent;

the urgency determination is used to select the movement mode; and the mission is urgent if a time for completion is less than a predetermined time threshold.

17. Computer software stored in non-transitory computer memory, the software comprising:

a first set of instructions operably monitoring a battery charge state of an autonomously controlled submersible;

a second set of instructions operably controlling a movement mode, wherein the movement mode is influenced by the battery charge state;

a third set of instructions operably controlling a buoyancy;

a fourth set of instructions operably collecting data using a plurality of sensors; and a fifth set of instructions operably transmitting the data to an external home base, wherein a mode of transmission is based at least on the battery charge state and a location;

wherein if a depth of the submersible in water is greater than a first predetermined level, the battery charge state is between medium and high, and a required speed is slower than a predetermined speed and the mission is not urgent, the movement mode is a combined swimming and gliding mode.

18. The computer software of claim 17, wherein if a depth of the submersible in water is greater than a first predetermined level, the battery charge state is below medium, and a required speed is slower than a predetermined speed and the mission is not urgent, the movement mode is an emergency power management mode.

19. The computer software of claim 15, wherein at least the second set of instructions further comprises:

autonomously selecting the movement mode based on a required speed, a depth of the submersible in water and the battery charge state;

the movement mode is at least one of: a swimming mode, a gliding mode, a propeller mode, a combined swimming and gliding mode, a combined gliding and swimming mode, and any combination thereof; and autonomously selectively controlling at least two of: a propeller, a buoyancy, and a center of gravity, to achieve the movement mode.

20. The computer software of claim 15, further comprising additional instructions operable to cause movement of a battery within the submersible to change a center of gravity of the submersible.

21. The computer software of claim 15, further comprising additional instructions monitoring a structural parameter of an underwater foundation and wirelessly transmitting information about the structural parameter monitored to a remote receiver.

22. The computer software of claim 15, further comprising additional instructions monitoring a water quality condition and wirelessly transmitting information about the water quality condition monitored to a remote receiver.

23. Computer software stored in non-transitory computer memory, the software comprising:

a first set of instructions operably monitoring a battery charge state of an autonomously controlled submersible;

a second set of instructions operably controlling a movement mode, wherein the movement mode is influenced by the battery charge state;

a third set of instructions operably controlling a buoyancy;

a fourth set of instructions operably collecting data using a plurality of sensors; and a fifth set of instructions operably transmitting the data to an external home base, wherein a mode of transmission is based at least on the battery charge state and a location;

wherein if a depth of the submersible in water is greater than a predetermined level and an ambient flow disturbance is less than a first predetermined threshold, the movement mode is a glide mode.

24. The computer software of claim 23, wherein if the depth is greater than the predetermined level and the ambient flow disturbance is greater than the first predetermined threshold and less than a second predetermined threshold, the movement mode is a combined gliding and swimming mode.

25. The computer software of claim 24, wherein if the depth is greater than the predetermined level and the ambient flow disturbance is greater than the second predetermined threshold and less than a third predetermined threshold, the movement mode is a swim mode.

26. The computer software of claim 23, wherein if the depth is greater than the predetermined level, the ambient flow disturbance is greater than another predetermined threshold, and the battery charge state is above a first predetermined state, the movement mode is a propeller mode.

27. The computer software of claim 26, wherein if the depth is greater than the predetermined level, the ambient flow disturbance is greater than the predetermined thresholds, and the battery charge state is greater than a second predetermined state and less than the first predetermined state, the movement mode is a combined swimming and gliding mode.

28. A method of controlling a robotic submersible comprising:

monitoring a battery charge state;

controlling a movement mode, wherein the movement mode is influenced by the battery charge state;

controlling a buoyancy;

collecting data using a plurality of sensors; and transmitting the data to an external home base, wherein a mode of transmission is based at least on the battery charge state and a location;

wherein if a depth of the submersible in water is greater than a predetermined level and an ambient flow disturbance is less than a predetermined threshold, the movement mode is a glide mode.

29. A method of controlling a robotic submersible comprising:

monitoring a battery charge state;

controlling a movement mode, wherein the movement mode is influenced by the battery charge state;

controlling a buoyancy;

collecting data using a plurality of sensors; and transmitting the data to an external home base, wherein a mode of transmission is based at least on the battery charge state and a location;

wherein if a depth of the submersible in water is greater than a predetermined level and an ambient flow disturbance is between predetermined thresholds, the movement mode is a combined gliding and swimming mode.

30. A method of controlling a robotic submersible comprising:

monitoring a battery charge state;

controlling a movement mode, wherein the movement mode is influenced by the battery charge state;

controlling a buoyancy;

collecting data using a plurality of sensors; and transmitting the data to an external home base, wherein a mode of transmission is based at least on the battery charge state and a location;

wherein if a depth of the submersible in water is greater than a predetermined level and an ambient flow disturbance is between predetermined thresholds, the movement mode is a swimming mode.

31. The method of claim 30, wherein if a depth of the submersible in water is greater than a predetermined level, an ambient flow disturbance is greater than a predetermined threshold, and the battery charge state is above a predetermined state, the movement mode is a propeller mode.

32. A method of controlling a robotic submersible comprising:

monitoring a battery charge state;

controlling a movement mode, wherein the movement mode is influenced by the battery charge state;

collecting data using a plurality of sensors; and transmitting the data to an external home base, wherein a mode of transmission is based at least on the battery charge state and a location;

wherein if a depth of the submersible in water is greater than a predetermined level, an ambient flow disturbance is greater than a predetermined threshold, and the battery charge state is between predetermined states, the movement mode is a combined swimming and gliding mode.

33. A method of controlling a robotic submersible comprising:

monitoring a battery charge state;

autonomously controlling a movement mode with a controller, the movement mode being influenced by the battery charge state;

autonomously collecting data using a plurality of sensors; and transmitting the data to an external home base, wherein a mode of transmission is based at least on a GPS location;

using the controller to autonomously cause an actuator to move a battery within the submersible to change a center of gravity of the submersible; and pivoting a tail fin with another actuator to propel the submersible at a speed of 1.5 m/s or less, with a power consumption of 5-10 W when the tail fin is pivoting, and the submersible weighing no more than 15 kg;

wherein if a depth of the submersible in water is greater than a first predetermined level, the battery charge state is below medium, and a required speed is slower than a predetermined speed and the mission is not urgent, the movement mode is an emergency power management mode.

34. The method of claim 33, wherein the movement mode is further influenced by at least two of: water depth, mission urgency, and ambient flow disturbance.

35. The method of claim 33, further comprising:

autonomously selecting the movement mode based on a required speed, a depth of the submersible in water and the battery charge state, wherein the movement mode is selected from at least two of: a swimming mode, a gliding mode, a propeller mode, a combined swimming and gliding mode, a combined gliding and swimming mode, and any combination thereof; and autonomously selectively controlling a propeller, a buoyancy, and a center of gravity, to achieve the movement mode.

* * * * *